US006517232B1

(12) United States Patent
Blue

(10) Patent No.: US 6,517,232 B1
(45) Date of Patent: Feb. 11, 2003

(54) MIXING SYSTEMS

(75) Inventor: David Blue, Elkhart, IN (US)

(73) Assignee: Becker-Underwood, Inc., Ames, IA (US)

( * ) Notice: Subject to any disclaimer, the term of this patent is extended or adjusted under 35 U.S.C. 154(b) by 0 days.

(21) Appl. No.: 09/592,478

(22) Filed: Jun. 9, 2000

Related U.S. Application Data

(63) Continuation-in-part of application No. 09/231,691, filed on Jan. 14, 1999, which is a continuation-in-part of application No. 08/650,871, filed on May 20, 1996, now Pat. No. 5,866,201.

(51) Int. Cl.[7] ..... B01F 7/02

(52) U.S. Cl. ..... 366/297; 366/319; 366/326.1; 366/329.1

(58) Field of Search ..... 366/297, 319, 366/320, 325.1, 336, 285, 329.1, 327.1, 326.1

(56) References Cited

U.S. PATENT DOCUMENTS

| | | | | |
|---|---|---|---|---|
| 649,232 | A | 5/1900 | Berger | |
| 1,735,393 | A | 11/1929 | Hiller | |
| 1,948,871 | A | 2/1934 | Quehl | |
| 2,620,173 | A | * 12/1952 | White | |
| 2,702,018 | A | 2/1955 | Gustafson | 118/417 |
| 3,421,740 | A | 1/1969 | Behrens | |
| 3,583,680 | A | * 6/1971 | Aust et al. | |
| 3,705,851 | A | 12/1972 | Brauer | |
| 3,732,697 | A | 5/1973 | Dickson | |
| 3,734,471 | A | 5/1973 | Engels | |
| 3,779,518 | A | * 12/1973 | Koepke et al. | |
| 3,841,102 | A | 10/1974 | Cinner et al. | |
| 3,856,278 | A | 12/1974 | Eisenmann | |
| 3,968,771 | A | 7/1976 | Walgenbach et al. | |
| 4,006,706 | A | 2/1977 | Lodige et al. | 118/303 |

(List continued on next page.)

FOREIGN PATENT DOCUMENTS

| | | |
|---|---|---|
| DE | 24 28 588 | 1/1976 |
| GB | 1099941 | 1/1968 |

OTHER PUBLICATIONS

"Marion Mixers, Engineered Solutions for Unique Mixing Application Since 1938", http://www.marionmixers.com/co.htm, visited on Aug. 10, 2000.

*The Revolutionary Second Harvester, Mulch Coloring System*, by Becker–Underwood, Inc., Marketing brochure, dated Oct. 1996.*

*Primary Examiner*—Tony G. Soohoo
(74) *Attorney, Agent, or Firm*—Drinker Biddle & Reath LLP

(57) ABSTRACT

A system includes a first pump to meter colorant and a second pump to pressurize a mixture of water and the colorant. Also included is a mixer body defining a chamber with an inlet and an outlet and one or more liquid input ports in fluid communication with the second pump to receive the mixture. The chamber receives solid pieces through the inlet and discharges the pieces through the outlet. One or more rotary conveying members are included that are positioned in the chamber to intermix the mixture and the solid pieces and convey the solid pieces from the inlet to the outlet. These members can be rotated by one or more drivers. A process and system for treating cinders are also disclosed.

8 Claims, 14 Drawing Sheets

U.S. PATENT DOCUMENTS 4,014,286 A 3/1977 De Zurik
4,015,830 A 4/1977 Lodige et al.
4,025,058 A 5/1977 Mizuguchi
4,067,140 A 1/1978 Thomas
4,079,696 A 3/1978 Weber
4,107,787 A 8/1978 Ocker
4,188,130 A 2/1980 Engels ..... 366/228
4,202,636 A 5/1980 Vanderveen
4,232,480 A 11/1980 Videen
4,290,702 A 9/1981 Klein et al.
4,323,367 A 4/1982 Ghosh
4,370,945 A 2/1983 Beckschulte et al. ..... 118/303
4,387,997 A 6/1983 Klein et al.
4,390,285 A 6/1983 Durr et al. ..... 366/168
4,396,402 A 8/1983 Ghosh
4,429,043 A 1/1984 Paton
4,460,292 A 7/1984 Durham et al.
4,474,852 A 10/1984 Craig
4,491,522 A 1/1985 Ishida et al.
4,514,090 A 4/1985 Neubauer et al.
4,516,524 A 5/1985 McClellan et al.
4,518,507 A 5/1985 Conner
4,527,902 A 7/1985 Christen ..... 366/169
4,559,142 A 12/1985 Morper
4,560,479 A 12/1985 Heijnen
4,586,459 A 5/1986 Schultz
4,681,457 A 7/1987 Orimo et al.
4,897,196 A 1/1990 Copa et al.
4,932,156 A 6/1990 Underwood
4,935,211 A 6/1990 Azar
4,987,850 A 1/1991 McCracken ..... 118/303
5,028,299 A 7/1991 Guidat et al. ..... 162/24
5,105,577 A 4/1992 Hedges
5,114,083 A 5/1992 Ikebuchi et al.
5,139,365 A 8/1992 Chesner
5,192,587 A 3/1993 Rondy
5,238,633 A 8/1993 Jameson
5,246,310 A 9/1993 Prange et al.
5,266,256 A 11/1993 Jerman et al.
5,267,788 A 12/1993 Rockstedt
5,308,653 A 5/1994 Rondy
5,354,127 A 10/1994 Del Zotto et al.
5,358,331 A * 10/1994 Cruse
5,358,738 A 10/1994 Sawka
5,372,459 A 12/1994 Prange et al.
5,401,534 A 3/1995 Bourreau et al.
5,486,327 A * 1/1996 Bemis et al.
5,562,956 A 10/1996 White, Jr.
5,569,811 A 10/1996 Dean
5,630,944 A 5/1997 Terblanche
5,643,170 A 7/1997 Dean
5,866,201 A 2/1999 Blue
5,895,511 A 4/1999 Tikhonova
6,321,804 B1 * 11/2001 Mangold

* cited by examiner

MIXING SYSTEMS

CROSS-REFERENCE TO RELATED APPLICATIONS

The present application is a continuation-in-part of commonly owned U.S. patent application Ser. No. 09/231,691 filed Jan. 14, 1999, which is a continuation-in-part of commonly owned U.S. patent application Ser. No. 08/650,871 filed May 20, 1996, now U.S. Pat. No. 5,866,201; and the commonly owned U.S. Patent Application entitled "Landfill Operation Techniques and Solid/Liquid Mixing Systems" filed on May 31, 2000, all of which are hereby incorporated by reference.

BACKGROUND OF THE INVENTION

The present invention relates to mixing solid pieces with a liquid, and more particularly, but not exclusively, relates to coating and coloration of landscaping materials.

There is a persistent interest in recycling materials. One type of material suitable for recycling is wood. Wood submitted for recycling may be of natural origin, such as discarded tree branches, or it may be derived from various discarded products, such as shipping crates and furniture. One way to recycle wood is to reduce the wood to a number of pieces of generally uniform size with a shredder, chipper, or grinder. Such comminuted wood is often suitable for use as a landscaping mulch. However, the varied types of wood available for recycling often result in a non-uniform coloration that significantly changes with age and exposure to the elements.

Another material for which recycling is often desired are the cinders resulting from steel manufacture and other industries. While some types of cinders of a fine-grained size may be suitable for use as a chemical agent, other cinder types—especially cinder pieces having a maximum dimension of at least one inch—are generally not suitable for such applications. Moreover, as in the case of wood, the non-uniform appearance of cinders is generally undesirable.

Thus, there is a demand for further contributions in this area of technology.

SUMMARY OF THE INVENTION

One form of the present invention is a unique technique for mixing solids and a liquid.

Another form of the present invention includes a unique mixing technique to impart color to solid pieces with a liquid.

Still another form of the present invention includes a unique technique to recycle solid pieces. Such recycling can include coloring the pieces to provide a landscaping material. The solid pieces can include wood chips, rocks, cinders, rubber, glass, comminuted paper products, or such other composition as would occur to those skilled in the art.

In a further form, a solid/liquid mixer is utilized to impart color to cinder pieces. As used herein, "cinder pieces" broadly include solid pieces of ash, fly ash, clinkers, slag, and/or any other residue of a combustion process.

Yet a further form of the present invention includes: placing the number of solid pieces into a mixing chamber through an inlet; preparing a mixture including water and a colorant; selectively metering the colorant provided to the mixture with a first pump; delivering the mixture to the chamber under pressure with a second pump; rotating one or more rotary members in the chamber to intermix the solid pieces and the mixture; and discharging the solid pieces through an outlet of the mixing chamber.

For another form, the system includes a liquid dispensing subsystem, a mixer body, one or more rotary conveying members, and one or more drivers. The liquid dispensing subsystem includes a first pump to meter colorant and a second pump to pressurize a mixture of the colorant and water. The mixer body includes a chamber with an inlet and an outlet and one or more liquid input ports in fluid communication with the second pump to receive the mixture under pressure. The chamber receives solid pieces through the inlet and discharges the pieces through the outlet. The one or more rotary conveying members are positioned in the chamber to intermix the mixture and the solid pieces and to convey the solid pieces from the inlet to the outlet. The one or more drivers provide rotational mechanical power to rotate the one or more rotary conveying members.

Yet another form of the present invention includes putting a number of cinder pieces in a mixing chamber through an inlet and placing a coloring liquid in the chamber to impart color to the cinder pieces. One or more rotary members are rotated in the chamber to convey the cinder pieces to an outlet of the chamber.

For the further form, a number of cinder pieces are placed in a mixing chamber through an inlet and a coloring liquid is introduced into the chamber. The cinder pieces and the coloring liquid are intermixed by rotating one or more rotary members in the chamber and the cinder pieces are discharged through an outlet of the chamber after this intermixing.

Among other forms of the present invention is a mixing system with a vessel for supplying a liquid and a device for supplying solid pieces to mix with the liquid. The system has an elongated enclosure with a first end opposing a second end. The enclosure defines a chamber in fluid communication with the vessel to receive the liquid. The chamber also has an inlet and an outlet with the inlet being closer to the first end than the outlet. The chamber receives the pieces from the device through the inlet and discharges the pieces through the outlet. A motor driven rotary conveying member positioned in the chamber between the first and second ends rotates about a rotational axis to intermix the liquid and pieces. The rotary conveying member includes one or more helical flights to convey the pieces from the inlet to the outlet when the rotary conveying member is rotated. The pieces can include cinders to be colored for use as a landscaping material.

In yet another form, the one or more flights are mounted about an elongated shaft configured to rotate about the rotational axis and a portion of at least one of the flights does not contact the shaft while turning about the rotational axis for at least three revolutions, defining a space therebetween.

In a further form, a mixing technique includes moving a number of cinder pieces within a mixing chamber and blending water and a colorant to produce a liquid colorant mixture for supply to the chamber. The colorant is metered to the mixture with a pump while maintaining a desired flow rate of the water to the mixture. At least a portion of the cinder pieces are colored in the chamber with the mixture. The cinder pieces are then discharged from the chamber.

Further forms, embodiments, objects, features, benefits, advantages, and aspects of the present invention shall become apparent from the drawings and description contained herein.

DESCRIPTION OF SELECTED EMBODIMENTS

Figure 1:
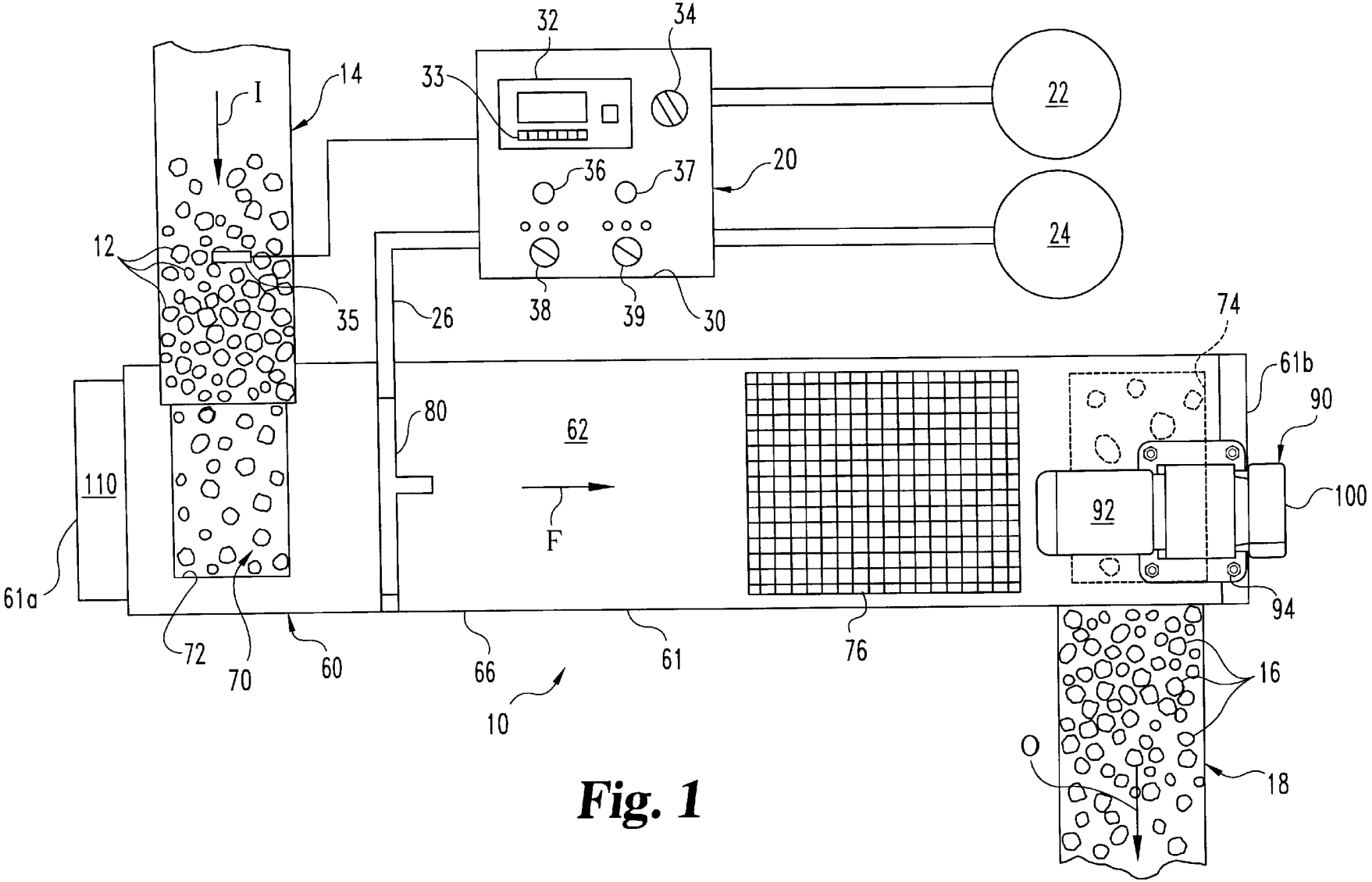
FIG. 1 is a schematic top view of a colorant mixing system of one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 depicts a colorant mixing system 10 of the present invention. In system 10, a number of wood chips 12 are transported by conveyer 14 in a direction along arrow I to mixer 60. The chips 12 enter chamber 70 of mixer 60 through inlet 72 and are processed therein. This processing includes mixing with a water-based colorant from liquid mixing subsubsystem 20. Processed wood chips 16 exit through outlet 74 of mixer 60 and are carried away by conveyer 18 in a direction along arrow O.

Subsystem 20 combines concentrated colorant from source 22 with water from water supply 24 to provide a liquid mixture for delivery to chamber 70 via conduit 26. Preferably, source 22 includes a vessel holding an ample supply of the concentrated colorant. Source 22 may include a plurality of vessels or a colorant dispensing sub-system. Water supply 24 is preferably a well water source or city water source of a conventional type.

Subsystem 20 includes control panel 30 with a display 32 indicating the rate colorant is being delivered for mixing. This rate may be continuously adjusted by an operator with rotary control 34. Control panel 30 also includes a control key pad 33, a master start switch 36, and a master stop switch 37. Switches 36, 37 start and stop subsystem 20, respectively. In addition, control panel 30 has switch 38 corresponding to water supply 24 and switch 39 corresponding to colorant source 22. Each switch 38, 39 has three positions: on, off, and automatic (or "auto"). When each switch 38, 39 is in the auto position, subsystem 20 operates normally. The on/off positions are used to separately start and stop water or colorant, respectively, for calibration purposes.

Subsystem 20 is also operatively coupled to sensor 35. Sensor 35 provides a stop signal corresponding to the absence of material on conveyer 14. This stop signal is then used to halt subsystem 20. Sensor 35 may be a microswitch with an actuation arm positioned above conveyer 14 a selected distance. This arm is configured to either open or close the microswitch when material on conveyor 14 of a selected height no longer contacts it. Opening or closing of this microswitch sends the corresponding stop signal. Other types of sensors as would occur to one skilled in the art are also contemplated.

Figure 2:
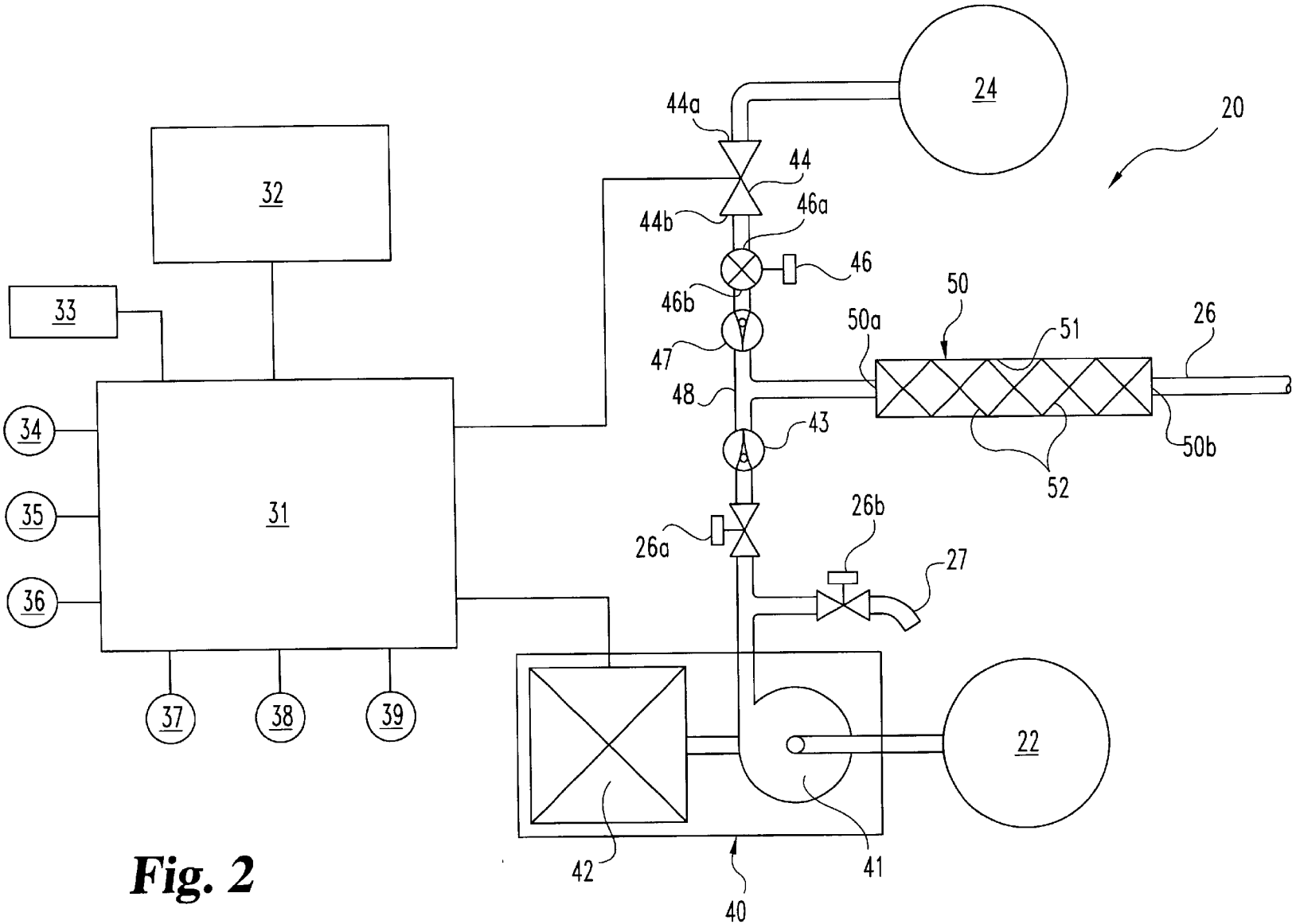
FIG. 2 is a diagrammatic view of the colorant dispensing system of FIG. 1.

Referring additionally to FIG. 2, further details of subsystem 20 are described. Controller 31 is operatively coupled to display 32, key pad 33, rotary control 34, sensor 35 and switches 36, 37, 38, and 39 to coordinate and supervise operation of subsystem 20. Controller 31 may be an electronic circuit comprised of one or more components. Similarly, controller 31 may be comprised of digital circuitry, analog circuitry, or both. Also, controller 31 may be programmable, an integrated state machine, or a hybrid combination thereof. However, preferably controller 31 is microprocessor with a known construction and has a control program loaded in non-volatile memory. In one embodiment a microcontroller/keyboard combination is supplied as Durant Model No. 5881-5 with part no. 5881-5-400 by Eaton Corporation of Waterloo, Wis., 53094.

Controller 31 is also coupled to pump system 40. Pump system 40 includes positive cavity control pump 41 coupled to source 22 and driven by motor 42. Controller 31 provides a delivery signal to motor 41 corresponding to a selected rate of delivery of concentrated colorant input to controller 31 with rotary control 34. In one embodiment, controller 31 responds to a stop signal from sensor 35 to generate a delivery signal which shuts down pump system 40. This delivery signal may alternatively be characterized as a "shut down" signal.

The colorant output by pump 41 encounters valves, 26*a*, 26*b*. Under usual operating conditions, valve 26*a* is open and valve 26*b* is closed so that colorant flows through check valve 43. Check valve 43 generally maintains "one way" flow of colorant away from pump 41. Colorant from check valve 43 empties into joining conduit 48. During calibration of pump system 40, valve 26*a* is closed, and valve 26*b* is open so that colorant flows through calibration outlet 27 for collection and possible reuse. Besides pump system 40, other metering devices as would occur to one skilled in the art are also contemplated.

Controller 31 is also operatively coupled to on/off valve 44 having inlet 44*a* in fluid communication with water supply 24, and outlet 44*b* for supplying water therefrom. Valve 44 is responsive to a signal from controller 31 to correspondingly start or stop water flow from supply 24. In one embodiment, controller 31 responds to a stop signal from sensor 35 to shut down water supply 24 by closing valve 44 via a shut down signal. Valve 44 may be a conventional solenoid activated stop valve.

Outlet 44*b* of valve 44 is in fluid communication with inlet 46*a* of flow regulator 46. Flow regulator 46 has outlet 46*b* in fluid communication with check valve 47. Check valve 47 maintains water flow away from flow regulator 46 to joining conduit 48. Flow regulator 46 maintains a generally constant flow rate of water. despite varying pressures at inlet 46*a* and/or outlet 46*b*. Accordingly, flow regulator 46 adjusts to maintain a generally constant pressure differential between inlet 46*a* and outlet 46*b*. Flow regulator 46 has an adjustable orifice to correspondingly select the regulated rate of flow from a given range of flow rates. In one embodiment, model no. JB11T-BDM from W. A. Kates, Co., 1450 Jarvis Avenue, Ferndale, Mich. 48220 is used for flow regulator 46 to provide a desired water flow rate selected from between 3 and 80 gallons per minute. In other embodiments, a different flow regulator may be used or a flow regulator may not be used at all.

Although water and concentrated colorant may begin mixing in joining conduit 48, static inline liquid mixer 50 provides a substantially homogenous liquid mixture of concentrated colorant diluted by water which is not generally provided by a conduit of generally constant internal cross-section. Concentrated colorant and water enter static liquid mixer 50 through inlet 50*a* and exit through outlet 50*b*. Static liquid mixer 50 is preferably made from a transparent PVC material so that blending cavity 51 therein may be observed. Within blending cavity 51 are a number of interconnected internal baffles 52. Baffles 52 are arranged to split the stream of liquid entering through inlet 50*a* and force it to opposite outside walls of mixer 50. A vortex is created axial to the center line of mixer 50 by the arrangement of baffles 52. The vortex is sheared and the process reoccurs but with opposite rotation several times along the length of static liquid mixer 50. This clockwise/counterclockwise motion mixes the liquid to provide a substantially homogenous mixture through outlet 50*b* and into conduit 26. Notably, static liquid mixer 50 operates without moving internal parts other than the liquid being mixed. This homogenous premixed liquid enhances uniform coloring of wood chips. Cole-Parmer Instrument Company of Niles, Ill. 60714 provides a PVC static liquid mixer model no. H-04669-59 for one embodiment of the present invention.

In other embodiments, a static mixing cavity arranged to promote mixing without internal baffles may be used. U.S. Pat. No. 4,516,524 to McClellan et al. is cited as a source of additional information concerning a dedicated static mixing cavity of this type. In still other embodiments, premixing of colorant and water prior to entry into chamber 70 is not necessary.

By controlling the rate of delivery of colorant with control 34 to static liquid mixer 50 and maintaining a generally constant flow rate of water with flow regulator 46, a desired concentration of water based colorant mixture may be selected. This concentration, and the rate of flow of the mixture to chamber 70 of mixer 60 may be matched to the rate of transport of wood chips therethrough to optimize colorant system 10 performance. As a result, the minimum amount of water necessary to provide uniform coloration for the wood chips may be determined by taking into account the absorbency of the liquid by the wood chips 12, the rate of flow of the liquid into chamber 70, and the rate of passage of wood chips 12 through mixer 60. Notably, the rate of liquid flow can be adjusted with flow regulator 46 and with rotary control 34, and the ratio of water to colorant can likewise be adjusted to assure a concentration which will provide uniform coloration. By optimizing these amounts, the amount of liquid runoff can be minimized and this optimal performance can be reliably reproduced. Also, an adjustable flow rate and colorant delivery rate permits re-optimization of the process when various parameters change; including, but not limited to, a different colorant type, different wood chip delivery rate, or different type of wood chips.

Besides optimizing colorant mixture delivery to mixer 60, in other embodiments controller 31 may also be used for a variety of record keeping functions, such as maintaining a record of the amount of colorant dispensed over a given period of time. The amount dispensed may be displayed or otherwise accessed by an operator using keypad 33. Controller 31 may be configured to provide an operator preferred parameters for flow regulator 46 and metering of colorant with pump system 40 via display 32 and keypad 33. Also, it may be configured to assist the operator with adjustments relating to different wood chip types, sizes, or delivery rates. In this embodiment, the speed of conveyer 14 may also be sensed with controller 31 to ascertain optimum liquid mixture parameters of subsystem 20. Also, controller 31 may control speed of conveyer 14 or 18, or otherwise be coupled to mixer 60 to control various operational aspects thereof. In one alternative embodiment, control panel 30, controller 31, display 32, control 34, and switches 36, 37, 38, 39 are embodied in a ruggedized personal computer customized with appropriate hardware and software to controllably interface with the other components of subsystem 20 and including a conventional video display and keyboard.

In an alternative embodiment, operator control via controller 31 is provided over the rate of water flow to the mixture instead of colorant. In this embodiment, colorant concentration is regulated by adjusting the amount of water with controller 31, and the colorant flow is kept generally constant. In other embodiments, both water supply 24 and source 22 are operatively coupled to controller 31 to provide dynamic adjustment over the relative flow rate and amount of from each. In still other embodiments, more than two sources of liquid components may be operatively coupled to controller 31 to provide a desired liquid mixture.

Delivery system 30 may also be used to control delivery of various other mixtures of liquid agents or mixing components. Also, besides wood chips, other solid pieces may be treated with a given liquid mixture from subsystem 20 in mixer 60. For example, a high gloss transparent coating on certain types of landscaping rocks or gravel may also be provided with system 10. Preferably, this clear coat is provided by a mixture of water and an organic-based polymer component.

In one alternative embodiment, cinder pieces are colored with system 10 in place of wood chips 12. The cinder pieces can include one or more of slag, fly ash, and/or clinkers, just to name a few. In one variation of this embodiment, at least a portion of the cinder pieces each have a maximum dimension of at least one inch.

Referring next to FIG. 1 and FIGS. 3–5, additional details concerning mixer 60 are next described. Mixer 60 includes enclosure 61 defining chamber 70. Enclosure 61 is elongated and has end 61*a* opposing end 61*b* along its length. Enclosure 61 has top 62 opposing base 64. Opposing sides 66 and 68 join top 62 and base 64. Top 62 defines inlet 72 and grated observation window 76. Preferably, top 62 is provided by panels which may be removed to gain access to chamber 70 for maintenance purposes. Base 64 defines discharge outlet 74.

Figure 3:
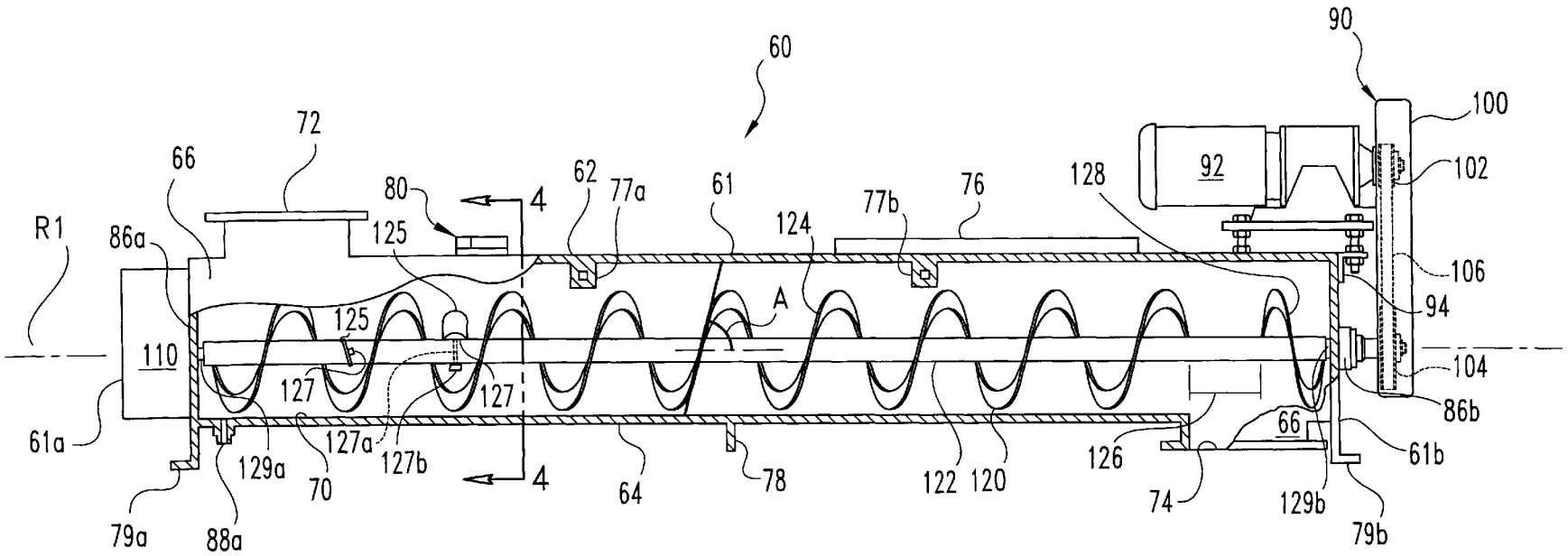
FIG. 3 is a partial cutaway, side view of the mixer of the system of FIG. 1.
Figure 4:
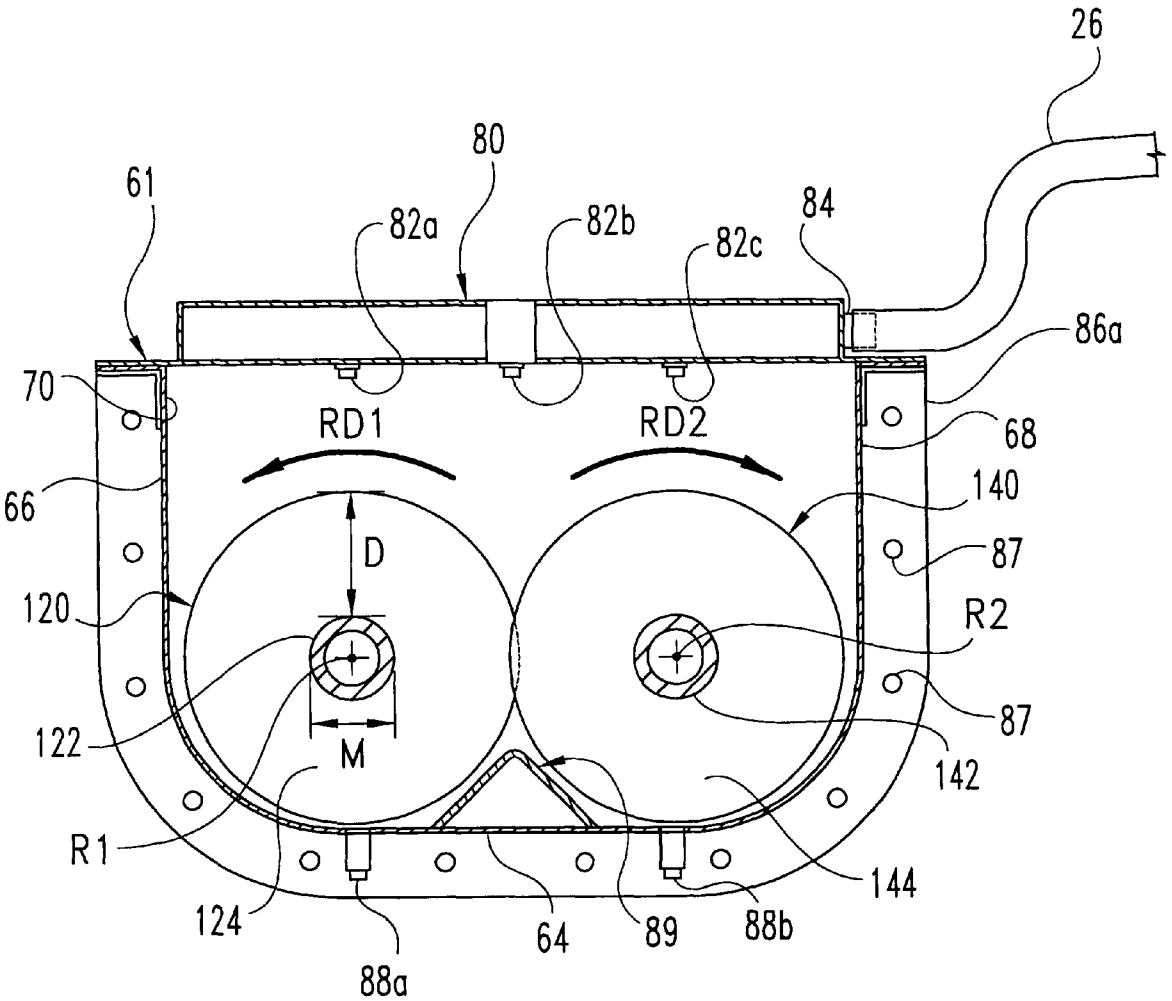
FIG. 4 is a side sectional view of the mixer shown in FIG. 3.

In FIG. 3 specifically, internal transverse support members 77*a*, 77*b* are shown in cross-section. Members 77*a*, 77*b* include a square cross-section and are preferably manufactured from carbon steel. Also, support flange 78 is illustrated between ends 61*a* and 61*b* of enclosure 61. Adjacent end 61*a*, 62*b* is a right angle bearing flange 79*a*, 79*b* which supports mixer 60. FIGS. 1, 3 and 4 illustrate a spray manifold 80. Spray manifold 80 is in fluid communication with spray nozzles 82*a,* 82*b,* 82*c* (collectively designated nozzles 82). In other embodiments, more or less nozzles may be used. Nozzles 82 are in fluid communication with chamber 70. Manifold 80 has intake 84 configured to receive liquid through conduit 26 for distribution within manifold 80 to nozzles 82. Excess liquid within chamber 70 may be drained through drain holes 88*a,* 88*b,* as particularly illustrated in FIGS. 3 and 4. Drain holes 88*a* and 88*b* are typically plugged during operation of mixer 60.

Referring specifically to FIG. 4, a cross-section of chamber 70 is shown. Also, protruding end flange 86*a* is illustrated with a number of attachment sights 87 along its periphery. End flange 86*a* is joined to bearing flange 79*a* using conventional methods. A similar structure at end 61*b* is formed with end flange 86*b* and bearing flange 79*b*. At the bottom of chamber 70 is a triangular partition 89. Preferably, enclosure 61 and manifold 80 are manufactured from a metallic material, such as carbon steel; however, other materials as occur to one skilled in the art are also contemplated.

Figure 5:
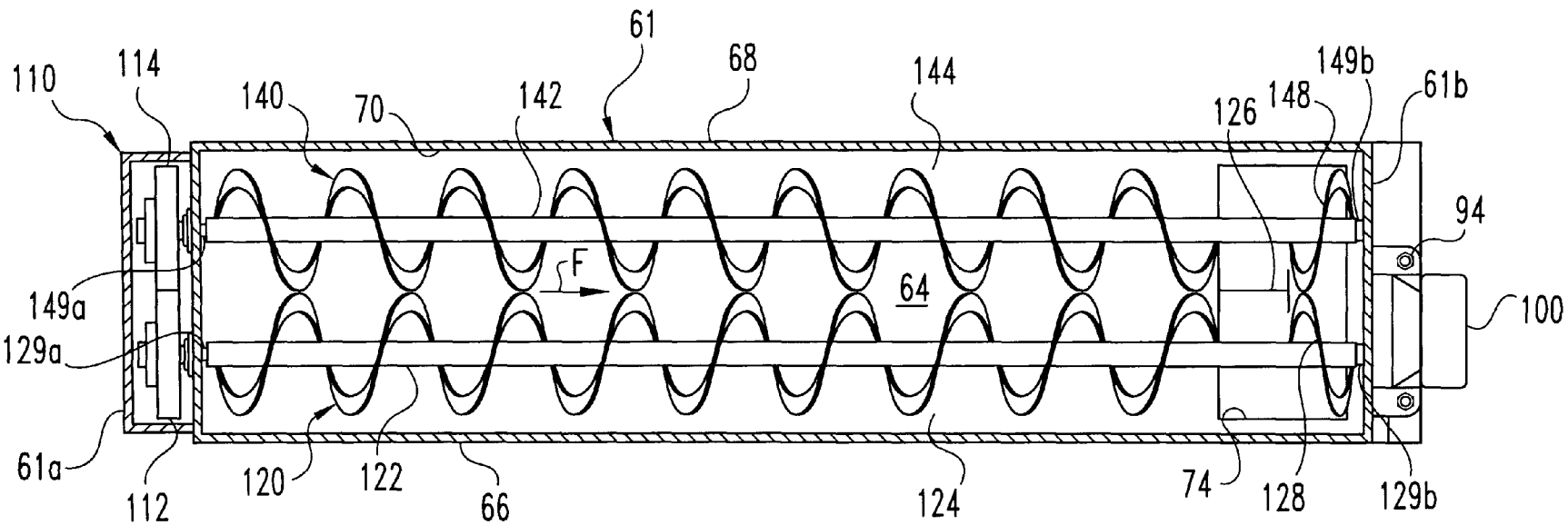
FIG. 5 is a top sectional view of the mixer shown in FIG. 3.

FIGS. 1, 3, and 5 depict various features of drive mechanism 90. Drive mechanism 90 includes motor 92 mounted to enclosure 61 by support 94. Also drive mechanism 90 includes drive box 100 and gear box 110. Preferably, motor 92 is electrically powered, but other types of prime movers can be employed, such as a gasoline-fueled internal combustion engine. A shaft from motor 92 extends into drive box 100 and is connected to sprocket 102 therein. Sprocket 102 is operatively coupled to sprocket 104 by drive chain 106.

Sprocket 104 is attached to auger 120 by coupling shaft 129*b* at the end of auger 120 closest to end 61*b* of enclosure 61. An opposing end of auger 120 is attached to coupling shaft 129*a* which extends into gear box 110. Within gear box 110, gear wheel 112 is coupled to coupling shaft 129*a* and intermeshes with gear wheel 114 coupled to coupling shaft 149*a*. Shaft 149*a* is coupled to auger 140 at the end of auger 140 closest to end 61*a* of enclosure 61. At the opposing end of auger 140, coupling shaft 149*b* is coupled thereto. Coupling shafts 129*a,* 149*a* are rigidly attached to shafts 122, 142, respectively, and are journaled to enclosure 61 at end 61*a* by appropriate bearings. Coupling shafts 129*b,* 149*b* are rigidly attached to shafts 122, 142 and are journaled to enclosure 61 at end 61*b* by appropriate bearings.

Referring specifically to FIGS. 3–5, auger 120, 140 are further described. Auger 120 includes a shaft 122 generally oriented along the length of enclosure 61. Attached to auger 120 is helical or spiral flight 124. Flight 124 is configured to turn about shaft 122 in a counterclockwise direction as it advances from end 61*a* toward end 61*b*. Preferably, flight 124 makes at least three revolutions about shaft 122. More preferably, flight 124 makes at least five revolutions about shaft 122. Most preferably, flight 124 makes at least nine revolutions about shaft 122.

Preferably, the pitch angle of flight 124 is at least 45°. More preferably, the pitch angle of flight 124 is in the range of 65° to 80°. Most preferably, the pitch angle of flight 124 is about 75°. As used herein, "pitch angle" means the angle formed between a tangent to an edge of the helical flight and the rotational axis of the flight. FIG. 3 illustrates a pitch angle of flight 124 as angle A. In one embodiment, the pitch angle of flight 124 varies, with a portion closest to end 61*a* having a different pitch angle than the rest of flight 124. In other embodiments, the pitch angle varies in a different fashion or is generally constant.

Referring specifically to FIG. 3, auger 120 includes mixing paddles 125 interposed along flight 124. Each mixing paddle 125 is attached to shaft 122 by fastener 127. Each fastener 127 has bolt 127*a* extending through shaft 122 and secured thereto by nut 127*b*. By loosening nut 127*b,* the pitch of mixing paddle 125 relative to flight 124 may be adjusted. Nut 127*b* is then re-tightened to secure the newly selected paddle pitch. Preferably, mixing paddles 125 do not extend as far from shaft 122 as flight 124. It is also preferred that auger 140 include mixing paddles distributed along shaft 142 which are interposed with flight 144 (not shown).

In one embodiment, about twelve mixing paddles 125 are distributed along shaft 122, being spaced along the segment of axis Ri corresponding to flight 124 at approximately equal intervals. From one to the next, mixing paddles 125 of this embodiment are positioned about axis R1 approximately 75 degrees apart. In addition, each mixing paddle has a portion extending from shaft 122 that has a generally planar sector shape. This sector shape sweeps about a 40 degree angle between radii extending from axis R1. Preferably, auger 140 is similarly configured for this embodiment.

Referring again to FIGS. 3–5, auger 120 also has a reverse spiral flight 128 spaced apart from flight 124 by gap 126 along shaft 122. Preferably, flight 128 turns around axis R1 at least 180 degrees. More preferably, flight 128 turns about axis R1 at least 330 degrees. Most preferably, flight 128 turns about axis R1 approximately 360 degrees or makes about one revolution around shaft 122 (including axis R1) between flight 124 and end 61*b*. Flight 128 advances in a direction from end 61*a* to 61*b* with a clockwise spiral rotation. Thus, the rotational direction of flight 128 is opposite the rotational direction of flight 124.

Generally, shaft 122 along gap 126 is flightless. The length of gap 126 along shaft 122 is preferably about the length of flight 124 along shaft 122 corresponding to one revolution about shaft 122. Gap 126 and flight 128 both partially overlap or overhang outlet 74 so that at least a portion of flight 128 is positioned over outlet 74.

Auger 140 is configured similar to auger 128 except the rotational orientation of the flighting is reversed. Specifically, helical flight 144 of auger 140 turns about shaft 142 in a clockwise direction as it advances from end 61*a* to end 61*b*. Flight 148 turns about shaft 142 in a counterclockwise direction as it advances in a direction from end 61*a* toward end 61*b*. Augers 120 and 140 preferably intermesh a slight amount as most clearly depicted in FIG. 4. This intermeshing is accomplished by slightly offsetting the maximum extension point of the flights relative to each other.

FIG. 4 illustrates additional characteristics of flight 124, 144. Shaft 122 has a maximum cross-sectional dimension (M) perpendicular to the plane of view of FIG. 4, and flight 124 has a distance D extending from shaft 122 along this plane. Preferably, the extension ratio (ER), of D to M is greater than 1; where ER=D÷M. More preferably, ER is at least 1.5, and most preferably ER is at least 2.0. The quantity M is determined as the maximum cross-sectional dimension of the shaft for its given shape along a cross-sectional plane perpendicular to its rotational axis. Similarly, D is determined as the distance the flight extends from the shaft along an axis perpendicular to the rotational axis of the shaft. Preferably, shafts 122, 144 each have a generally right cylindrical shape, presenting an approximate circular cross-section perpendicular to rotational axes R1, R2; and flights 124, 128, 144, 148 present a generally circular cross-section along a plane perpendicular to the rotational axes R1, R2 of the shafts 122, 142, respectively.

Generally referring to FIGS. 1–5, selected operational features of mixer 60 are next discussed. Solid pieces, such as wood chips 12, enter inlet 72 of enclosure 61 via conveyer 14. When activated, motor 92 turns sprocket 102 which rotates sprocket 104 via chain 106. Rotation of sprocket 104 turns auger 120 about rotational axis R1 in the direction RD1, driving auger 120 in a counterclockwise or "left hand" direction. Rotational axes R1, R2 are shown in FIG. 4 as cross-hair points generally concentric with the cross-section of shafts 122, 142, respectively. Notably, these axes are generally parallel to each other and are parallel to the longitudinal axis of augers 120, 140, and enclosure 61.

The rotation of auger 120 turns gear wheel 112 contained in gear box 110. Gear wheel 112 rotates gear wheel 114 in response in the opposite direction. Correspondingly, auger 140 rotates along with gear wheel 114 in a clockwise or "right hand" direction indicated by arrow RD2.

Rotation of flights 124, 144 of auger 120, 140 about axes R1, R2 provides an "archimedes screw" type of conveyer which transports solid pieces entering inlet 72 along the direction indicated by arrow F, from end 61*a* toward end 61*b*. At the same time that flights 124, 144 move material along arrow F, flights 124, 144 also tumble and intermix the solid pieces with a liquid colorant mixture sprayed into chamber 70 via nozzles 82. The liquid mixture is supplied by subsystem 20 to manifold 80. The mixing of the liquid and solid pieces continues as it travels past manifold 80 and by window 76 along arrow F. Mixing paddles 125 assist intermixing by agitating the mixture of solid pieces and liquid. Preferably, mixing paddles 125 are pitched to oppose the flow of material along arrow F; and thereby enhance mixing. By adjusting the pitch of mixing paddles 125 relative to flight 124, the average dwell time in chamber 70 of a given material may be changed. This feature further assists in controlling application of the liquid mixture to the solid pieces to minimize run-off of excess liquid.

As gap 126 is encountered by material moving through chamber 70, processed wood chips 16 begin to exit through outlet 74 to be carried away by conveyer 18 in a direction indicated by arrow O.

Unfortunately, the wet mass of material at gap 126 has a tendency to stick together—despite gravity urging it to fall through outlet 74. As a result, material may occasionally bridge gap 126 and encounter either or both of flights 128 and 148. Because flights 128, 148 oppose the rotational orientation of flights 124, 144, respectively; flights 128, 148 both tend to move material opposite the direction of arrow F—that is in a direction away from end 61*b*. The opposing configurations of flights 124, 144 with respect to flights 128, 148 tend to break up a mass of material bridging gap 126 to thereby facilitate discharge through outlet 74. Consequently, the auger configuration of mixer 60 tends to reduce the incidence of material packing in outlet 74 and so reduces the number of mixing interruptions due to jamming or clogging.

Mixer 60 may be used with a variety of liquid mixture types for coating or adhering a desired substance to solid pieces. Preferably, mixer 60 is used so that the direction of the flow along arrow F is generally horizontal. However, in other embodiments, mixer 60 may be inclined in varying amounts as would occur to one skilled in the art.

Figure 6:
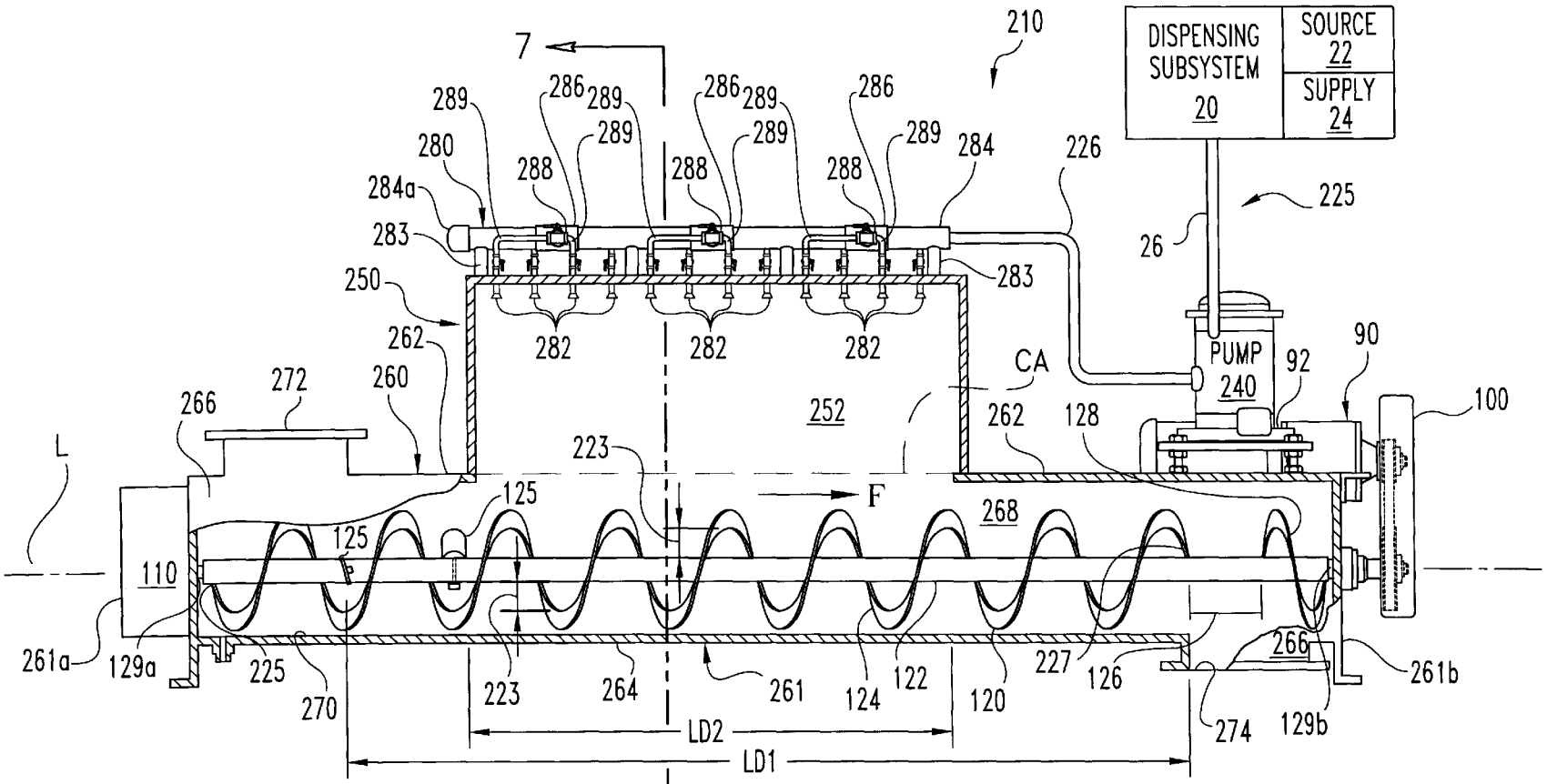
FIG. 6 is a partial cutaway, side view of a mixing system of another embodiment of the present invention.
Figure 7:
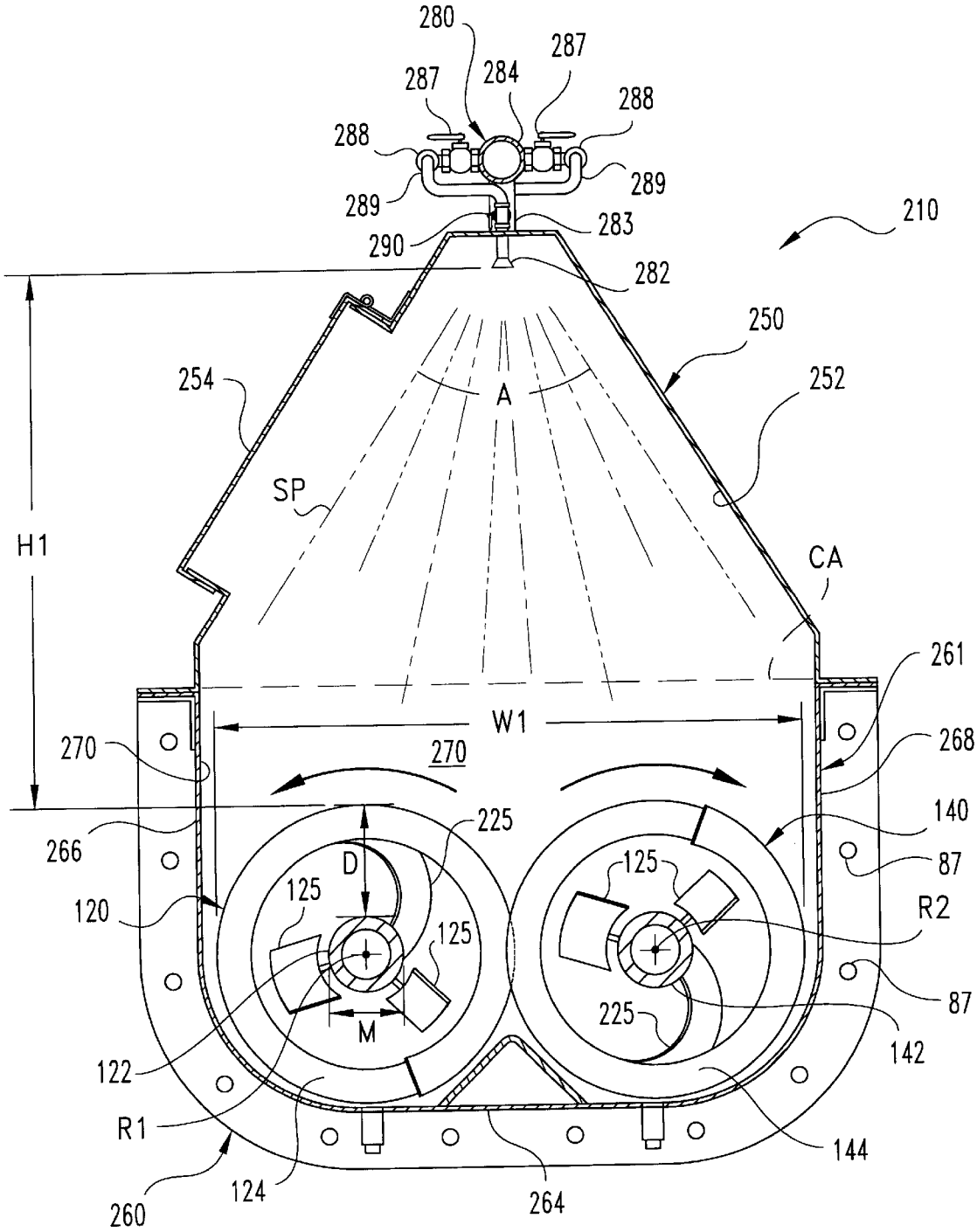
FIG. 7 is a partial sectional view of the mixer taken along section line 7—7 of FIG. 6.

FIGS. 6 and 7 depict mixing system 210 of another embodiment of the present invention; where certain reference numerals are the same as those used in connection with system 10 and are intended to represent like features. System 210 includes liquid dispensing subsystem 225, spray hood 250, and mixer 260. Subsystem 225 includes liquid mixing subsystem 20. As previously described, subsystem 20 is controller-based and regulates the blending of a mixture of an agent from source 22 with water from supply 24. Likewise, as described in connection with mixing system 10, the regulation and control processes implemented with subsystem 20 also apply to system 210.

Liquid dispensing subsystem 225 also includes pump 240 with a liquid inlet to receive the liquid mixture provided by subsystem 20 via conduit 26. Pump 240 increases pressure or pressurizes the mixture received from subsystem 20. Conduit 226 is in fluid communication with a liquid outlet of pump 240 and spray hood 250. Pump 240 delivers the pressurized mixture to spray hood 250 via conduit 226. In one embodiment, pump 240 is arranged to provide the liquid mixture with a pressure in a range of about 200 to 400 pounds per square inch (psi). In other embodiments, pump 240 can provide a different pressure or is absent.

Mixer 260 is coupled to spray hood 250 and includes a mixing trough 261 extending along its longitudinal axis L with opposing ends 261*a*, 261*b*. Trough 261 is partially covered by top 262. Top 262 is opposite base 264. Trough 261 is bounded by opposing side walls 266, 268 and defines a mixing passage 270. Trough 261 has inlet 272 defined through top 262 adjacent end 261*a* and outlet 274 defined through base 264 adjacent end 261*b*. Inlet 272 and outlet 274 intersect passage 270. Inlet 272 and outlet 274 are separated from each other along axis L by distance LD1.

Disposed within passage 270 are augers 120, 140. Augers 120, 140 extend from inlet 272 to outlet 274 and are turned by drive mechanism 90 with motor 92 via drive box 100 and gear box 110 as described in connection with mixer 60 of system 10. Augers 120, 140 have shafts 122, 142 and helical flights 124, 144, respectively, as previously described. As shown in FIG. 6, a space 223 is defined between flight 124 and shaft 122 except at the ends 225, 227 which are connected to shaft 122. Space 223 corresponds to a cross-section along axis L having a generally circular outer and inner contour bounded by flight 124 and shaft 122, respectively. A like space is preferably defined between flight 144 and shaft 142 of auger 140. To accommodate mixing, it is also preferred that space 223 extend between shaft 122 and flight 124 for a distance corresponding to at least three revolutions of flight 124 about shaft 122. More preferably, this distance corresponds to at least six revolutions of flight 124 about shaft 122. Most preferably, flight 124 is separated from shaft 122 and does not make contact therewith, defining space 223 therebetween, except where connected at ends 225 and 227.

Further, FIG. 6 depicts flight 128 overlapping outlet 274 with an opposite rotational direction relative to flight 124. Flight 124 is separated from flight 128 by a flightless gap 126 along shaft 122. Preferably, auger 140 has a second flight sized and positioned like flight 128 with a rotational direction opposite flight 144 as described in connection with system 10. The second flights 128, 148 for each auger 120, 140, respectively, have been found to reduce clogging at outlet 274. Also as described in connection with system 10, augers 120, 140 preferably include adjustable mixing paddles 125. Paddles 125 may be utilized to adjust dwell time of products being mixed in trough 261.

Spray hood 250 defines chamber 252 and has a hinged access door 254 to facilitate maintenance as is best depicted in FIG. 7. Manifold 280 is connected to the top of hood 250 and includes a number of spray nozzles 282 for delivering the liquid from subsystem 20 to chamber 252 via supply conduit 284. Supply conduit 284 is in fluid communication with conduit 226 to receive the pressurized mixture from pump 240. Several brackets 283 support conduit 284 along hood 250 above nozzles 282. Conduit 284 terminates in end cap 284*a*.

Referring to FIG. 7, it is preferred that each nozzle 282 have a spray pattern SP that subtends an angle A. Preferably, angle A is at least 60 degrees. More preferably, angle A is at least 80 degrees. One preferred nozzle 282 is model no. USS8060 provided by Spraying Systems Company having a business address of P. O. Box 7900, Wheaton, Ill. 60189-7900. This model is of the VEEJET line and sprays about 6 gallons per minute when supplied liquid at a pressure of about 40 lbs. per square inch (psi). Preferably, at least 8 nozzles are utilized. More preferably, at least 12 nozzles are utilized as depicted in FIG. 6.

Figure 8:
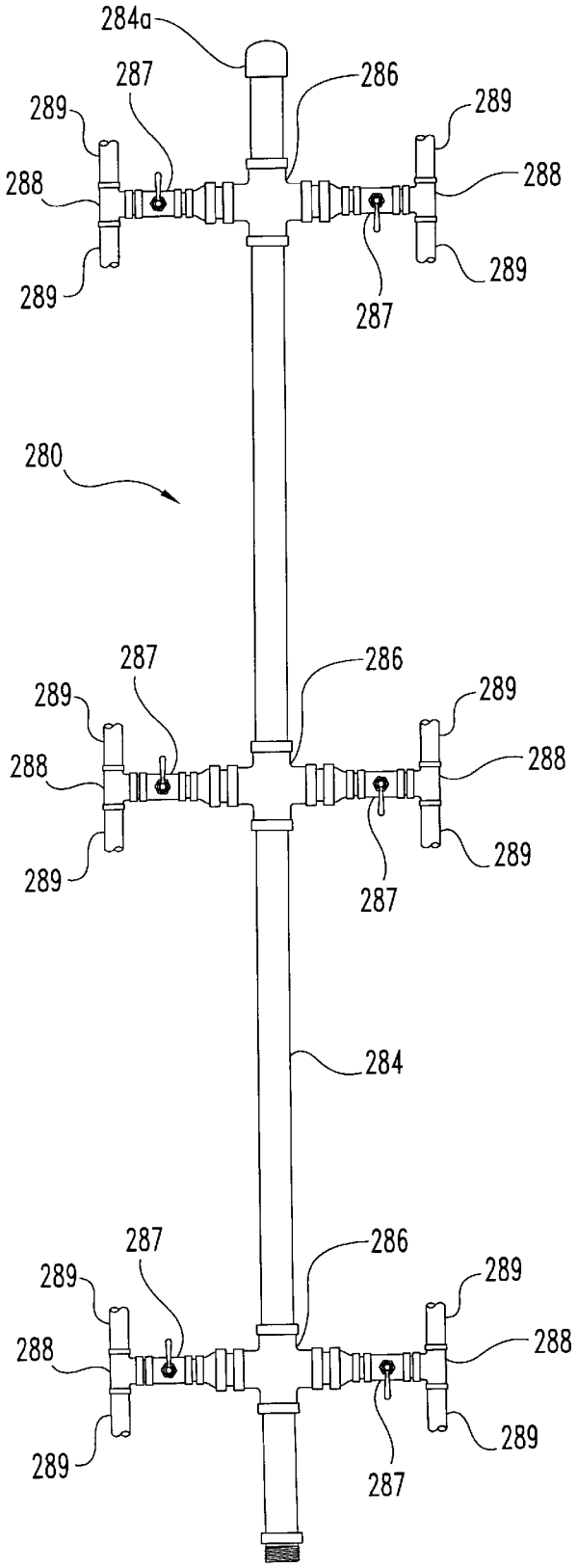
FIG. 8 is a partial, top view of the manifold shown in FIGS. 6 and 7.

Referring additionally to FIG. 8, conduit 284 of manifold 280 includes a four-way conduit junction 286 for every four nozzles 282. Each junction 286 is in fluid communication with two valves 287 on opposite sides thereof. Each valve 287 is in fluid communication with a "T" junction coupling 288. A hose 289 is coupled to each opposite end of coupling 288 to a corresponding valve 290 in fluid communication with one of nozzles 282. Thus, for the configuration depicted in FIG. 6, three junctions 286, six valves 287, and six "T" junction couplings 288 are utilized. Further, there are twelve hoses 289 and twelve valves 290 each corresponding to one of nozzles 282.

In one preferred embodiment of hood 250, chamber 252 is defined by a metal enclosure and door 254 is similarly formed from metal. For this embodiment, conduit 284 of manifold 280 is preferably formed from a two-inch diameter PVC pipe and junctions 286 are each provided as a four-way two-inch PVC connector. Valves 287 and 290 are of a half-inch variety and may be adjusted by hand. For this embodiment, transition members/reducers are used between values 287 and corresponding junctions 286. Couplings 288 are likewise formed from PVC and hoses 289 are of a standard reinforced rubber type for this embodiment.

At the intersection of chamber 252 with passage 270 an area for contacting pieces in trough 261 is defined. This area is designated as contact area CA in FIGS. 6 and 7. Area CA has a length LD2 along the distance LD1 as shown in FIG. 6. Preferably, distance LD2 is at least about half of distance LD1. More preferably, distance ID2 is at least two-thirds of distance LD1. Augers 120, 140 occupy a maximum width across passage 270 below spray hood 250 represented as width W1 in FIG. 7. W1 is the maximum transverse distance across axis L collectively occupied by augers 120, 140. Area CA preferably has a width that is at least one-half the width W1. More preferably, the width of area CA is at least about three-fourths of the width W1. Most preferably, the width of area CA is substantially all of width W1 as shown FIG. 7.

In correspondence with area CA, nozzles 282 are spaced at intervals along axis L to provide a collective spray pattern along distance LD2. Preferably, the spray pattern has a length of at least about one-half of distance 1LD1 and a width at least about one-half of width W1. More preferably, the length of the spray pattern along axis L is at least about two-thirds the distance LD1 and a maximum width of at least about three-fourths of width W1. Most preferably, the spray pattern has a length generally the same as distance LD2 that is greater than or equal to about two-thirds of the distance LD1 and a width that is substantially all of the width W1 at a number of intervals along the distance LD2. As depicted in FIG. 7, it is also preferred that nozzles 282 be separated from augers 120, 140 by a height of at least one-half W1 to facilitate dispersal of the liquid from subsystem 20 in chamber 252 before contacting solid pieces being carried through passage 270.

In operation, mixer 260 is configured to accept solid pieces through inlet 272 which are then advanced along passage 270 towards outlet 274 in the direction indicated by arrow F by turning augers 120, 140 with drive mechanism 90. As the pieces are advanced with augers 120, 140, they are tumbled and intermixed facilitating coating, coloring, or another mixing process with a liquid introduced through spray hood 250. The pieces passing through mixer 260 may be, for example, wood chips of a suitable size and consistency for use as a mulch and the liquid delivered with subsystem 20 may be a mixture of a liquid colorant and water to impart a desired color to the wood chips.

Collectively, the valves 287, 290 may be adjusted to provide a desired spray pattern within chamber 252 with nozzles 282. For example, each valve 290 may be adjusted to selectively reduce or shut-off the spray from the nozzle 282 coupled thereto. Valves 287 may each be used to shut-off or adjust flow to each respective pair of nozzles 282 coupled thereto via a corresponding coupling 288, pair of hoses 289, and pair of valves 290. In one mode of operation, valves 287 are used to make coarse adjustments and valves 290 are used to make fine adjustments. By selectively adjusting valves 287, 290 and parameters of subsystem 20 previously described, greater control over the mixing process may be obtained. In one alternative embodiment, these nozzles are electronically controlled by a controller to establish various predetermined patterns (not shown).

Moreover, it has been found that the expansive spray pattern of system 210 facilitates a reduction in water usage needed in order to color wood chips to provide a suitable mulch with a generally uniform color. It is believed this reduction in water consumption results because the amount of chip surface area contacted by the color-imparting spray is greater than with existing systems, so that the amount of color-imparting liquid that needs to freely flow in trough 261 to properly color the wood chips is comparatively less. However, it should be understood that it is not intended that the claimed invention be limited to any stated mechanism or theory.

Several experiments were performed using equipment arranged as described for system 210. A number of different types of wood based products were colored in a manner suitable to serve as a mulch. The tested products may be as much as 40% by volume saw dust with the balance being wood pieces having a maximum dimension in a range of about ½ inch to about 2 inches. Also, the tested product has a widely varying moisture content. Coloration was performed by contacting the wood product with a liquid coloring mixture obtained by mixing a concentrated liquid colorant with water. Water consumption of 10 gallons or less per cubic yard of wood product colored was observed under these conditions. This result indicates at least a 20% reduction in water consumption compared to other coloration systems.

In one preferred embodiment, system 210 is used to color wood chips provided in a consistency suitable for application as a mulch; however, in another embodiment, a scent is additionally supplied in order to simulate a known type of mulch such as eucalyptus, cedar, or pine. For this embodiment, scent may be dispensed in a liquid form from a separate system comparable to subsystem 20 and may be introduced into chamber 252 through one or more nozzles 282 instead of the colorant mixture. Alternatively, the scent may be homogeneously mixed with colorant and water before being dispensed to hood 250, or a single vessel containing concentrated liquid colorant and scent that has been premixed may be mixed with water in subsystem 20 and subsequently supplied to hood 250.

In still other embodiments, system 210 may be used with a variety of liquid mixture types for coating or adhering a desired substance to solid pieces. Also, solid pieces other than wood chips may be processed in this manner, such as rocks, cardboard, synthetic resin pieces, and the like. In one alternative embodiment, color is imparted to cinder pieces with system 210. These pieces can include slag, fly ash and/or clinkers, to name just a few. In one form of this embodiment, at least a portion of the cinder pieces have a maximum dimension of one inch or greater. Moreover, while mixer 260 generally can be maintained in a horizontal position during use, in other embodiments, trough 261 may be inclined in varying amounts as would occur to one skilled in the art.

Figure 9:
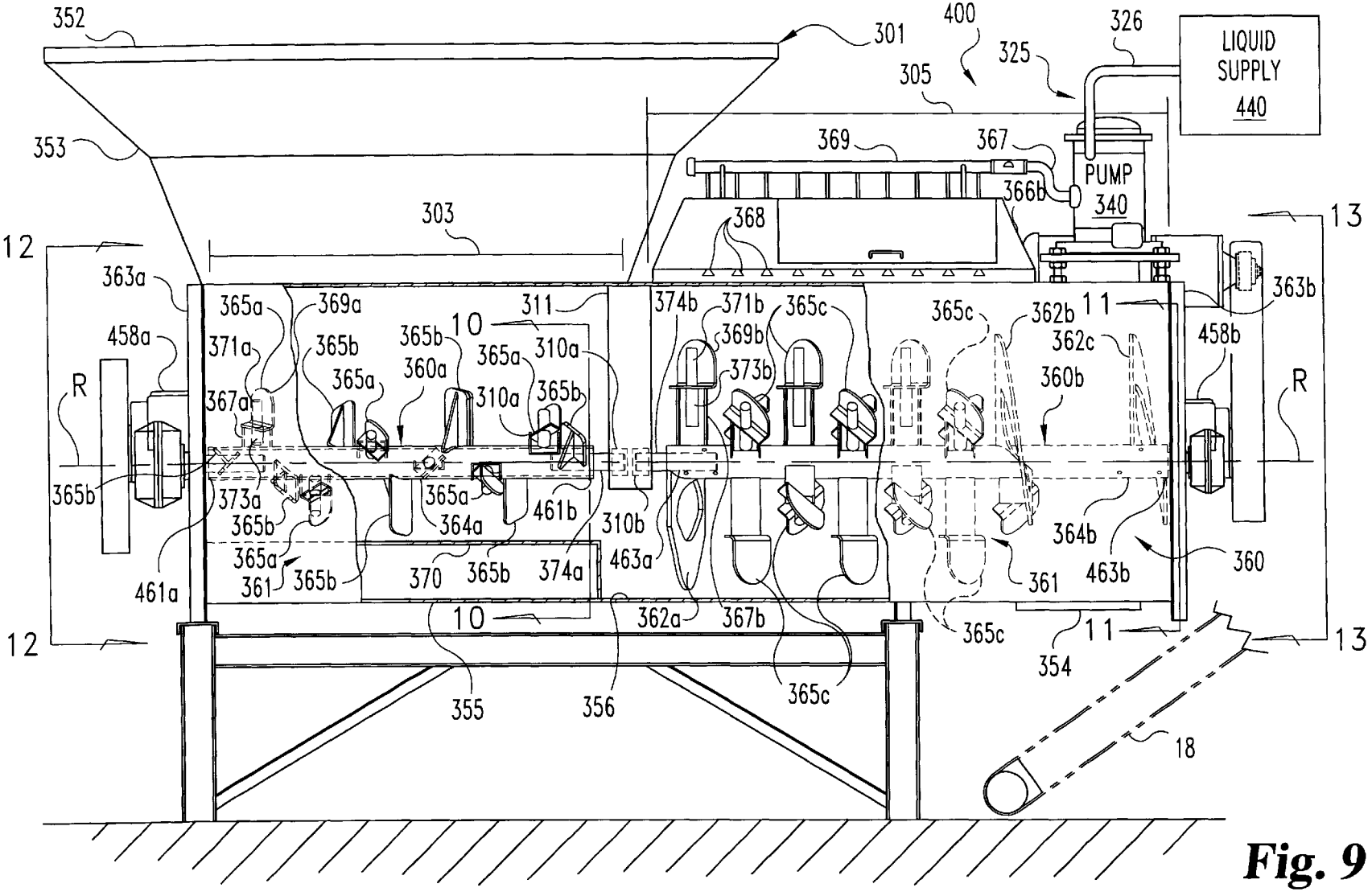
FIG. 9 is a partial cutaway, side view of a mixer system of still another embodiment of the present invention with selected internal features diagrammatically shown in phantom.

FIG. 9 depicts mixer system 400 of another embodiment of the present invention. System 400 can be used in a wide variety applications in which it is desirable to mix solid pieces and a liquid. Such applications include, but are not limited to, the treatment of wood chips, rocks, cinders, rubber, glass, and/or comminuted paper products with a liquid to impart coloration, a translucent or transparent coating, and/or a scent to the pieces; or the treatment of landfill material with landfill leachate as described in the commonly owned U.S. Patent Application entitled "Landfill Operation Techniques and Solid/Liquid Mixing Systems" filed on May 31, 2000.

System 400 includes conveyer 18, as previously described in connection with system 10, and mixer 301. Mixer 301 includes body 355 defining mixing chamber 356 with inlet 352 and outlet 354. More particularly, body 355 of mixer 301 is elongate, having a first end 363*a* opposing a second end 363*b* along axis R, which extends along the length of body 355. Mixer 301 is further designated as having first section 303 along a first segment of axis R and second section 305 along a second segment of axis R. Inlet 352 is disposed between the first end 363*a* and outlet 354 and intersects chamber 356 along a top portion of body 355. Chamber 356 is configured to receive solid pieces through inlet 352 with the assistance of gravity. Inlet 352 is further defined by funnel/hopper member 353, which is sized to contain a desired volume of solid pieces to be processed with mixer 301.

Once introduced into chamber 356, the solid pieces are processed, as will be more fully described hereafter, and are then discharged with the assistance of gravity through outlet 354. Outlet 354 is defined in the bottom portion of body 355. In other embodiments, inlet 352 and/or outlet 354 can be formed partially or completely through a respective end 363*a,* 363*b* or a lateral side portion of body 355, or can be otherwise oriented as would occur to those skilled in the art.

System 400 also includes liquid dispensing subsystem 325. Liquid dispensing subsystem 325 includes pump 340 and liquid supply 440. Supply 440 is further described in connection with FIG. 14 hereinafter. Conduit 326 couples supply 440 to an inlet of pump 340 to supply a liquid. Pump 340 is arranged to increase the liquid pressure. In one embodiment, pump 340 provides a liquid pressure in a range of about 200 to about 400 psi. In other embodiments, the pressure provided by pump 340 can differ, or pump 340 can be absent. From pump 340, the pressurized liquid exits through an outlet in fluid communication with supply conduit 367.

Supply conduit 367 provides the pressurized liquid to liquid input ports 368. Ports 368 are in the form of spray nozzles arranged to provide a desired spray pattern for the controlled application of liquid to solid pieces in chamber 356. Liquid source conduit 367 is positioned over mixing chamber 356 to supply liquid to a distribution manifold that passes through hood 366*b* to ports 368. Ports 368 are positioned beneath hood 366*b* as depicted in FIG. 9. Hood 366*b* and ports 368 are positioned above chamber 356 at a location between inlet 352 and outlet 354. In one embodiment, subsystem 325 is arranged with a spray hood and manifold configuration the same as that of system 210 previously described.

Mixer 301 also includes conveying/mixing subsystem 360 to move the solid pieces introduced into inlet 352 of the first section 303 to outlet 354 of second section 305, and to mix liquid from subsystem 325 with these pieces. System 360 includes rotary conveying member 360*a* in section 303 and rotary conveying member 360*b* in section 305. Members 360*a,* 360*b* are each disposed within chamber 356 along axis R.

Figure 10:
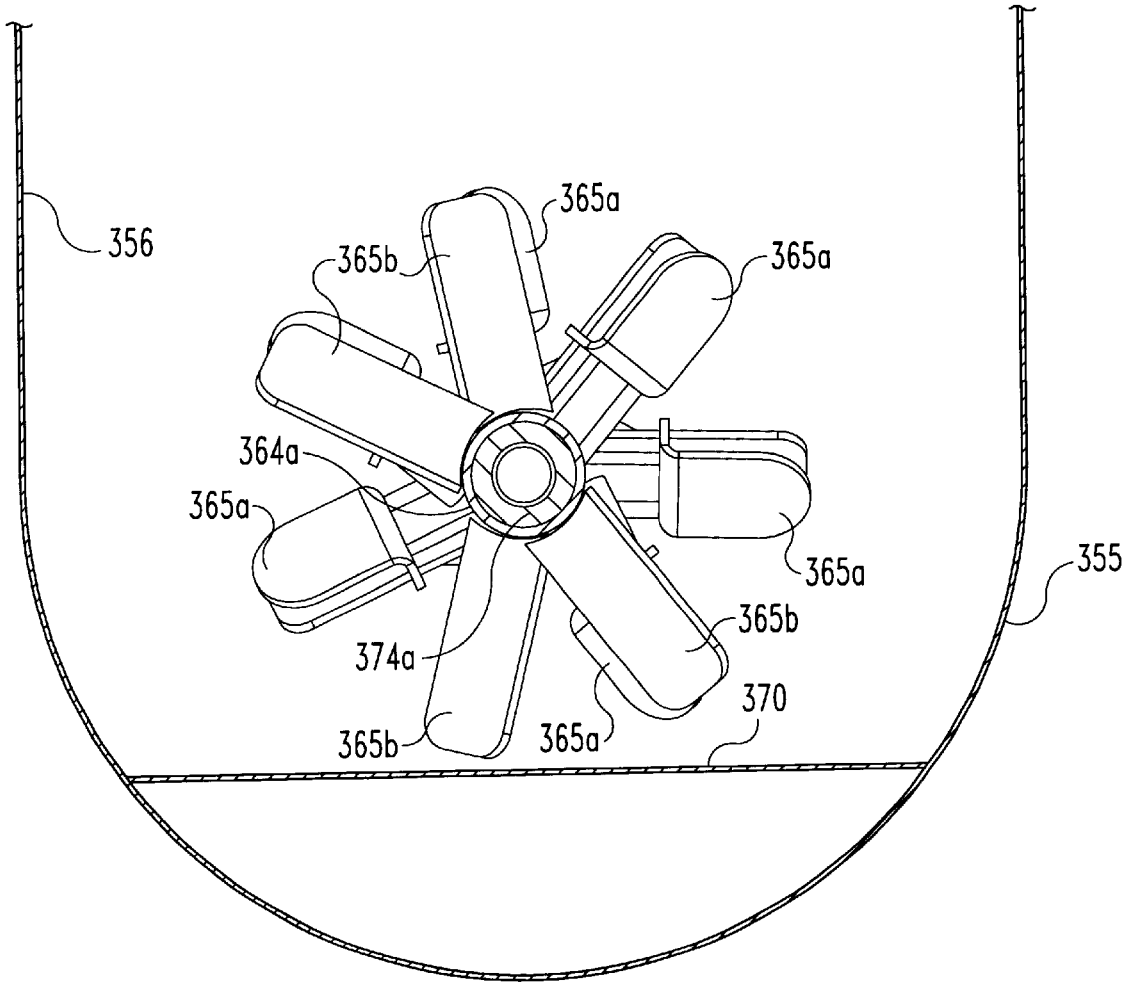
FIG. 10 is a cross sectional view of the mixer of FIG. 9 taken along the section line 10—10 of FIG.9.
Figure 11:
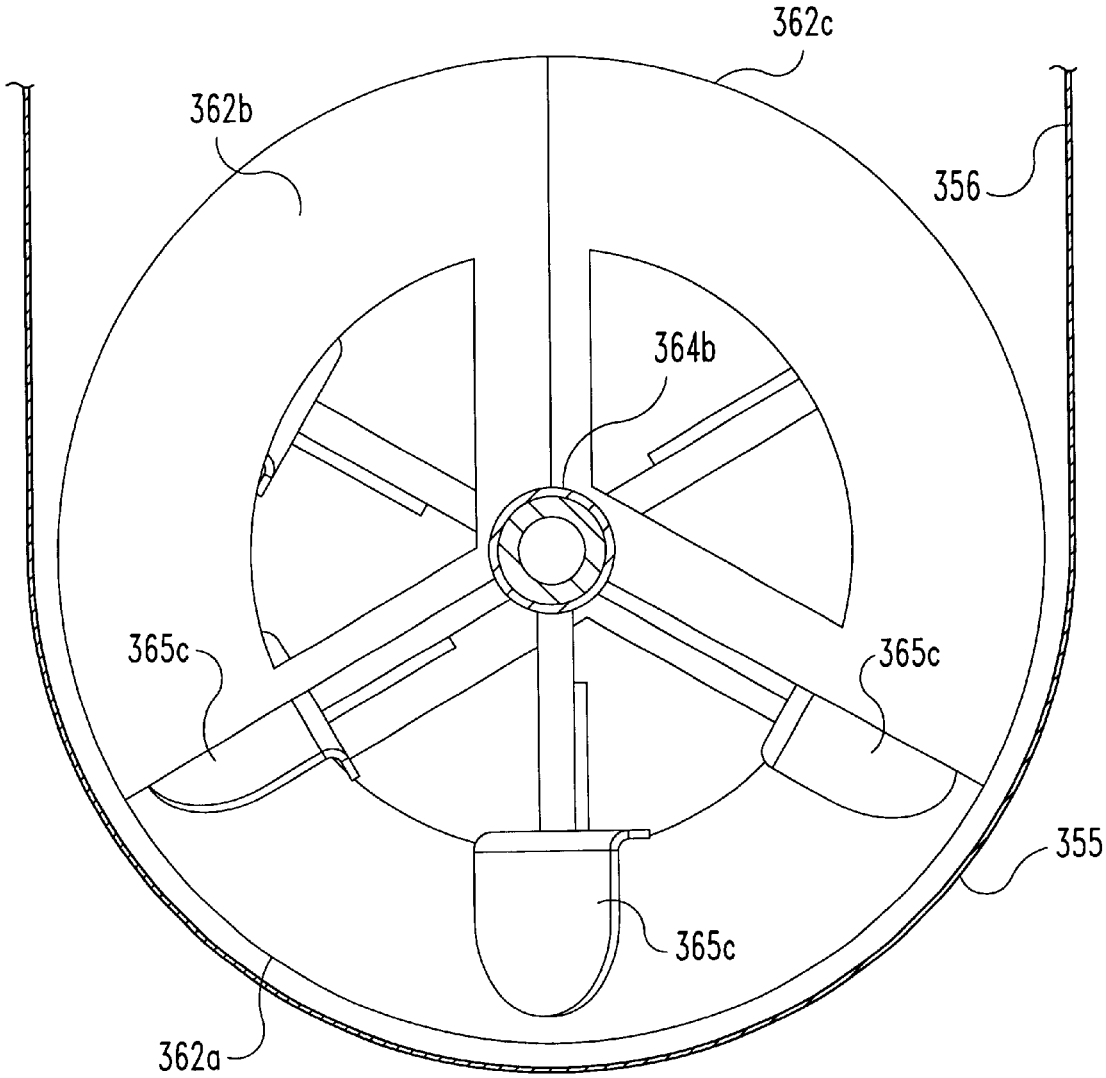
FIG. 11 is another cross sectional view of the mixer of FIG. 9 taken along the section line 11—11 of FIG. 9.

Referring additionally to FIGS. 10 and 11, rotary conveying member 360*a* includes shaft 364*a* and rotary conveying member 360*b* includes shaft 364*b*. Shaft 364*a* of member 360*a* has opposing ends 461*a,* 461*b* and shaft 364*b* of member 360*b* has opposing ends 463*a,* 463*b*. Rotary conveying member 360*a* aligns with rotary conveying member 360*b* in an end-to-end relationship such that end 461*b* and end 463*a* are closer together than ends 461*a* and 463*b*.

Members 360*a,* 360*b* also include structures 361 that extend from the respective shafts 364*a* and 364*b* to advance solid pieces from inlet 352 to outlet 354 as shafts 364*a* and 364*b* are each rotated about axis R in a designated rotational direction (clockwise or counterclockwise). By way of non-limiting example, structures 361 can include spiral threading, paddles, flights, or the like affixed to shafts 364*a,* 364*b*. It should be understood that the orientation of the extending structures determines the direction of travel of pieces along axis R for a given rotational direction of shaft 364*a,* 364*b;* such that the rotational direction that advances the pieces could be same for each member 360*a,* 360*b* or different.

For rotary conveying member 360*a,* structures 361 include adjustable-pitch paddles 365*a* and fixed-pitch paddles 365*b* that each radially extend from shaft 364*a* about axis R. Paddles 365*a* each include base 367*a* fixed to shaft 364*a* and adjustable paddle member 369*a* extending from base 367*a*. Base 367*a* has sleeve 373*a* fixed thereto. Member 369*a* includes coupling rod 371*a* that engages sleeve 373*a* of base 367*a*. Rod 371*a* is selectively fixed to base 367*a* by one or more set screws (not shown) threaded through one or more corresponding openings in sleeve 373*a* to adjustably contact rod 371*a*. Reference numerals 367*a,* 369*a,* 371*a,* and 373*a* are designated for only one of paddles 365*a* in FIG. 9 to preserve clarity. The pitch of each member 369*a* of each paddle 365*a* can be angularly adjusted by loosening the corresponding set screw(s), positioning rod 371*a* within sleeve 373*a* to locate member 369*a* as desired, and retightening the set screw(s).

Fixed-pitch paddles 365*b* alternate with adjustable-pitch paddles along axis R. Paddles 365*a,* 365*b* are spaced apart from one another along axis R, and are also angularly spaced apart from one to the next about axis R. In the depicted embodiment, the angular spacing about axis R between a given pair of paddles 365*a,* 365*b* is approximately 52 degrees, such that paddles 365*a,* 365*b* follow a generally helical path about axis R. For the depicted embodiment, the pitch of each of paddles 365*b* is approximately 45 degrees. In other embodiments, the type of adjustable paddle 365*a* can differ, the pitch of paddles 365*b* can differ from one another or have a different common pitch; the angular spacing of the paddles 365*a,* 365*b* along and/or about axis R can differ; there can be more or fewer paddles 365*a* and/or 365*b;* and/or different types of extending structures such as threading or flighting can be employed.

Structures 361 for rotary conveying member 360*b* include a number of pitch-adjustable paddles 365*c* and a number of flights 362*a,* 362*b,* 362*c*. Paddles 365*c* each radially extend from shaft 364*b* about axis R. Paddles 365*c* each include base 367*b* fixed to shaft 364*b* and adjustable paddle member 369*b* extending from base 367*b*. Base 367*b* has sleeve 373*b* fixed thereto. Member 369*b* includes coupling rod 371*b* that engages sleeve 373*b* of base 367*b*. Rod 371*b* is selectively fixed to base 367*b* by one or more set screws (not shown) threaded through one or more corresponding openings in sleeve 373*b* to adjustably contact rod 371*b*. Reference numerals 367*b,* 369*b,* 371*b,* and 373*b* are designated for only one of paddles 365*c* in FIG. 9 to preserve clarity. The pitch of each member 369*b* of each paddle 365*c* can be angularly adjusted by loosening the corresponding set screw (s), positioning rod 37lb within sleeve 373*b* to locate member 369*b* as desired, and retightening the set screw(s).

For the depicted embodiment, flight 362*a* is positioned adjacent end 463*a* on shaft 364*b* at generally the same distance along axis R as one of paddles 365*c*. Also, flight 362*b* is positioned on shaft 364*b* with another paddle 365*c* at an approximately common distance along axis R adjacent outlet 354. Flight 362*b* is positioned between flight 362*a* and 362*c* and partially extends over outlet 354. Between flights 362*a,* 362*b,* groups of paddles 365*c* are positioned at generally regular intervals of distance along shaft 364*b* and axis R. At each interval, the members of the corresponding group of paddles are angularly spaced apart from one another by approximately 320 degrees. Flight 362*c* extends over a portion of outlet 354 opposite flight 362*d* and is adjacent end 363*b* of mixer 301. Flight 362*c* is oriented with a rotational direction opposite that of flights 362*a,* 362*b* to reduce the likelihood of clogs in the vicinity of outlet 354. As depicted, flights 362*a,* 362*b,* 362*c* each occupy approximately a 320 degree sector about axis R. It should be understood that in other embodiments, the rotational direction and/or amount of revolution(s) a flight has about axis R can differ; the type of paddle can differ; the angular spacing between paddles about axis R can differ; there can be more or fewer paddles and/or flights; and/or other types of structures for rotary conveying member 360*b* can be utilized.

A shelf 370 is attached to body 355 in section 303 of chamber 356, thereby providing a raised platform in section 303. Correspondingly, paddles 365*a,* 365*b* have a smaller radial extension from shaft 364*a* than do paddles 365*c* from shaft 364*b*. In other embodiments, mixer 301 does not include a shelf, and paddles in section 303 can generally have the same length as paddles in section 305.

End 461*b* of rotary conveying member 360*a* and end 463*a* of rotary conveying member 360*b* meet at coupling support member 311 that extends into chamber 356 from an upper portion of body 355. Coupling support member 311 carries a pair of journal bearings 310*a,* 310*b*. Journal bearing 310*a* is engaged by coupling shaft 374*a* that extends from end 461*b* of shaft 364*a* and journal bearing 310*b* is engaged by coupling shaft 374*b* that extends from end 463*a* of shaft 364*b* to rotatably couple shafts 364*a* and 364*b* to support member 311. Shafts 364*a* and 364*b* are also journaled at ends 363*a* and 363*b* of body 355, respectively. As an alternative, or in addition to, the presence of coupling support member 311, at least a portion of one of ends 461*b,* 463*a* can include a recess sized and shaped to receive the other of ends 461*b,* 463*a* in a rotational bearing relationship. In still other embodiments, a different journaling arrangement is utilized as would occur to those skilled in the art.

Members 360*a* and 360*b* can have a wide variety of lengths, and the coupling support member 311 can be positioned in a wide variety of locations relative to other components of mixer 301. As depicted, ends 461*b* and 463*a* meet between inlet 352 and outlet 354. As members 360*a* and 360*b* are rotated to move material through chamber 356, they share a generally common rotational and longitudinal axis coincident with axis R.

Figure 12:
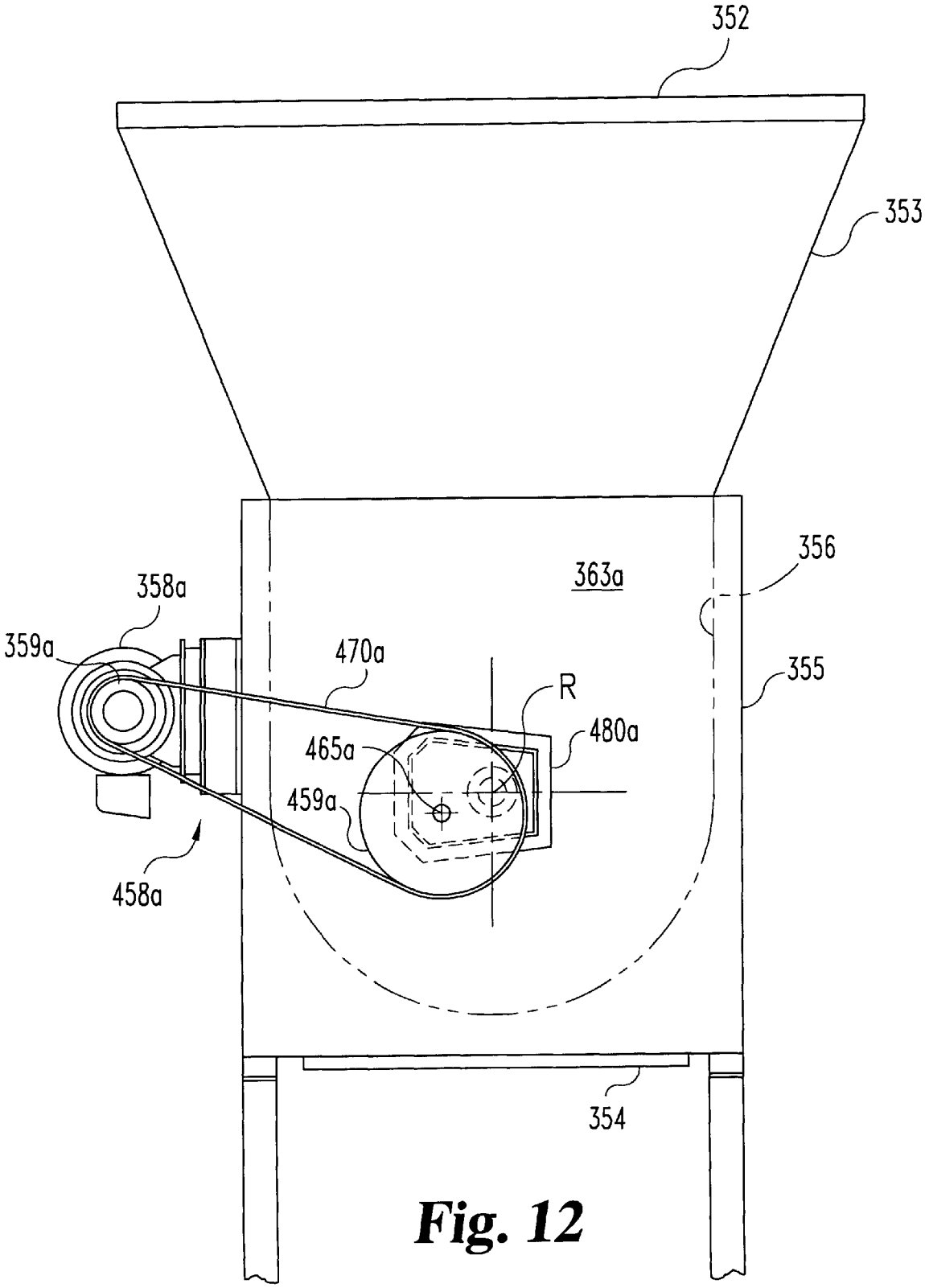
FIG. 12 is an end elevational view of the mixer of FIG. 9 taken along the view line 12—12 of FIG. 9.
Figure 13:
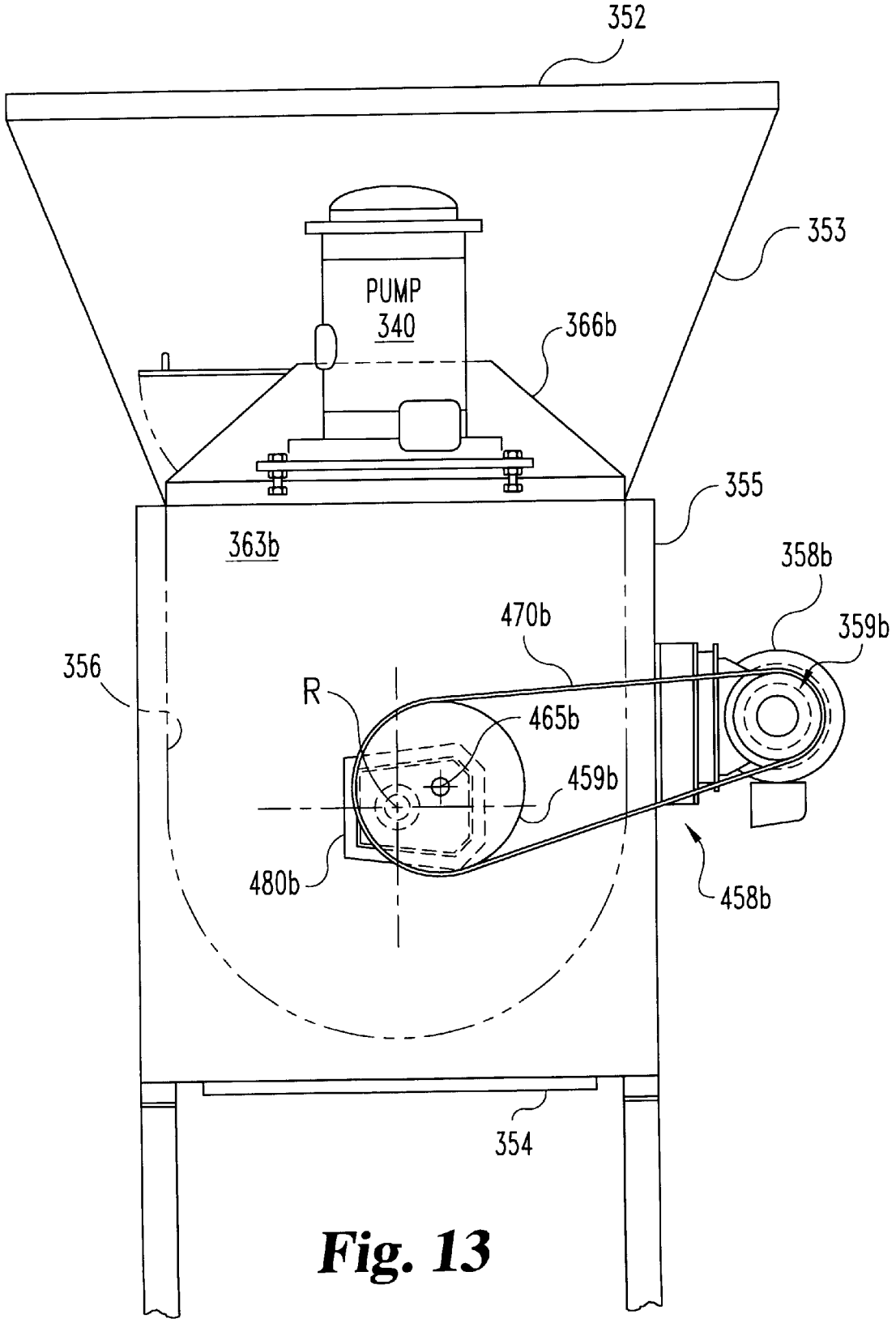
FIG. 13 is another end elevational view of the mixer of FIG. 9 taken along the view line 13—13 of FIG. 9.

Members 360*a,* 360*b* are operable to be independently and selectively rotated at different rates by drive mechanisms 458*a,* 458*b,* respectively. Furthermore, drive mechanisms 458*a,* 458*b* are arranged to optionally reverse rotational direction of members 360*a,* 360*b* as will be more fully described hereinafter. Referring to FIGS. 12 and 13, drive mechanisms 458*a,* 458*b* include drivers 358*a,* 358*b* with drive sheaves 359*a,* 359*b,* respectively. Drive sheaves 359*a,* 359*b* are rotatably coupled to sheaves 459*a,* 459*b* by corresponding drive belts 470*a,* 470*b*. Alternatively, this rotary coupling can be provided by meshed gears, a chain and sprocket arrangement, a clamming arrangement, frictionally engaged rollers, a combination of these, or such other arrangement as would occur to those skilled in the art.

Sheaves 459*a,* 459*b* have rotational centers 465*a,* 465*b,* respectively. The rotational centers of shafts 364*a,* 364*b* are coincident with axis R, which is perpendicular to the view plane of FIGS. 12 and 13, and therefore designated by cross-hairs. It should be understood that rotational centers 465*a,* 465*b* are each offset from axis R. Reducers 480*a* and 480*b* rotatably couple sheaves 459*a* and 459*b* to shafts 364*a* and 364*b,* respectively. Reducers 480*a,* 480*b* provide a reduction in the rate of rotation of the respective shafts 364*a,* 364*b* relative to the speed of corresponding sheaves 459*a,* 459*b*. Indeed, members 360*a* and 360*b* can be rotated at different rates by using reducers 480*a* and 480*b* with different turn ratios.

In one embodiment, drivers 358*a,* 358*b* are each in the form of an electric motor. In alternative embodiments, the drivers 358*a,* 358*b* can be in the form of an internal combustion engine, a hydraulic motor, a steam driven turbine, a pneumatic motor or another type of prime mover as would occur to a person of ordinary skill in the art. In one alternative embodiment, a common source of rotational mechanical power, such as a single electric motor, is used to drive members 360*a* and 360*b*. In this embodiment (not shown), the motor engages two drive shafts, one extending beyond end 363*a* of mixer 301, and the other extending beyond end 363*b* of mixer 301. At a position along one drive shaft generally planar to sheave 459*a,* sheave 359*a* is attached. A belt drives sheave 459*a* with sheave 359*a* as described above. At a position along the other drive shaft generally planar to sheave 459*b,* sheave 359*b* is attached. Another belt drives sheave 459*b* with sheave 359*b* as described above. In still another embodiment, one of drive mechanisms 458*a* or 458*b* is modified to turn a drive shaft that extends along the length of body 355 and terminates in a sheave to power a drive mechanism at the opposite end. In this manner, a single source of rotational mechanical power can be used to drive both rotary conveying members. In yet other embodiments, different drive linkages or devices are used, or one or more of shafts 364*a,* 364*b* are directly driven by a driver.

Figure 14:
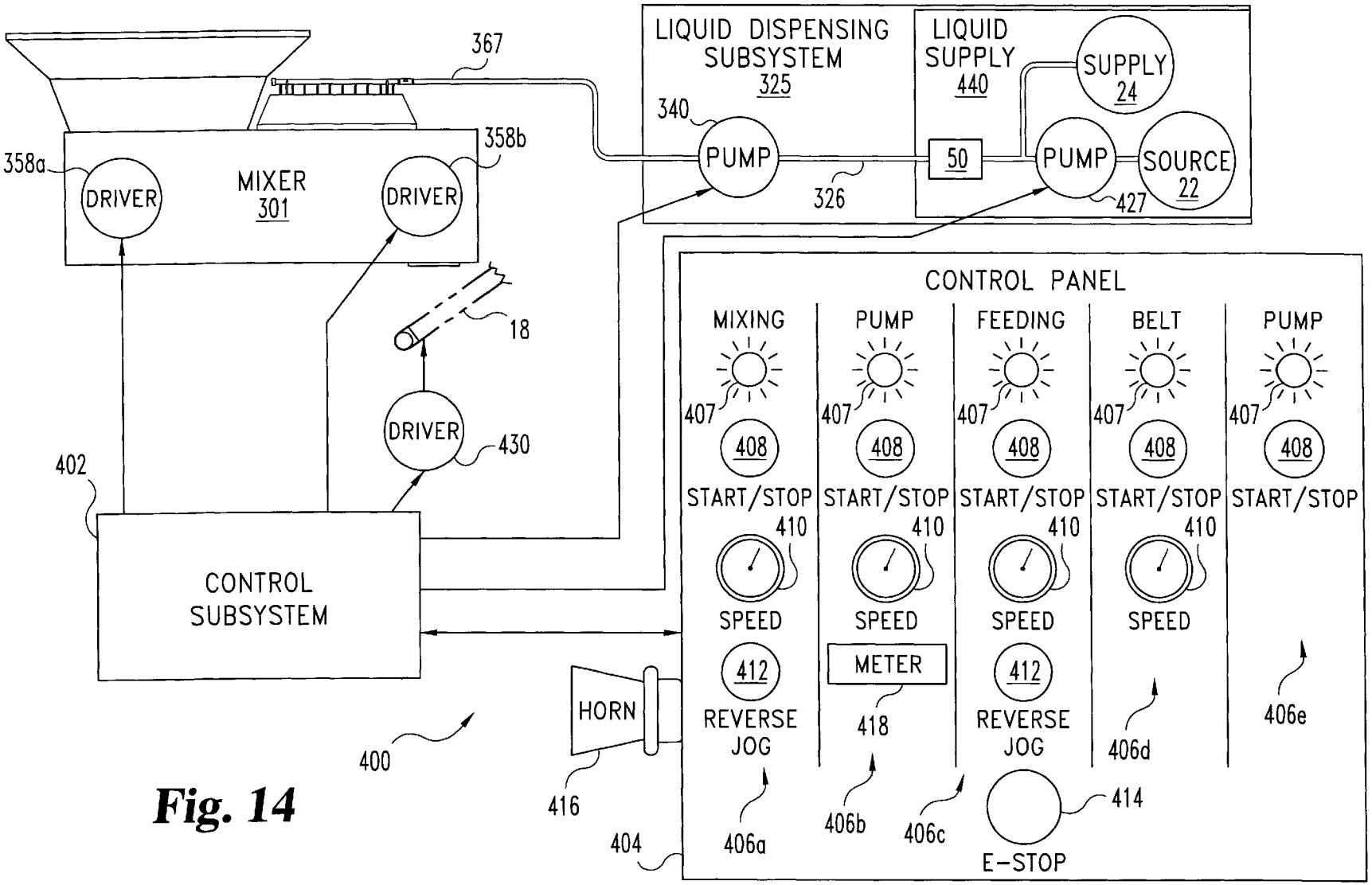
FIG. 14 is a schematic diagram of the system of FIG. 9.

Referring to FIG. 14, other features of system 400 are illustrated. Liquid supply 440 is further illustrated with source 22, supply 24, pump 427, and liquid mixer 50; where like reference numerals refer to like features of subsystem 20 previously described. An inlet of pump 427 is coupled to source 22 to selectively meter colorant for mixing with water from supply 24. Liquid mixer 50 blends the water and colorant constituents to provide a more uniform consistency of the resulting mixture. The mixture output by mixer 50 is supplied to conduit 326 for delivery to pump 340 to be pressurized as previously described in connection with FIG. 9. Liquid supply 440 can include valves, regulators and other structures of subsystem 20 to facilitate colorant/water mixing. In other embodiments, more or fewer pumps and metered liquid constituents can be utilized within subsystem 325, and/or subsystem 325 can include other dispensing equipment, liquid mixers, regulators, and valves as would occur to those skilled in the art. In one alternative embodiment, liquid supplied with subsystem 325 requires no mixing prior to delivery.

In FIG. 14, driver 430 for conveyor belt 18 is illustrated that may be controlled to move discharged pieces away from outlet 354 after processing by mixer 301. Also schematically illustrated are drivers 358*a,* 358*b* of mechanisms 458*a,* 458*b* of mixer 301. System 400 further includes control subsystem 402 and operator control panel 404.

Control subsystem 402 is operatively coupled to drivers 358*a,* 358*b,* 430, and pumps 340, 427 to selectively control the operation thereof in response to one or more input signals from control panel 404. Control panel 404 is arranged in a number of columns 406*a,* 406*b,* 406*c,* 406*d,* 406*e* of operator controls and indicators that correspond to operation of rotary conveying member 360*b* (labeled "mixing"), pump 427 (labeled "pump"), rotary conveying member 360*a* (labeled "feeding"), conveyor 18 (labeled "belt"), and pump 340 (labeled "mixture pump") respectively. Each column 406*a*–406*e* includes an indicator light 407 that is illuminated when the corresponding driver or pump is active. Immediately below the respective indicator light 407 of each column 406*a*–406*e,* is a start/stop toggle push button 408. In cooperation with control subsystem 402, start/stop toggle push button 408 alternatively activates and deactivates the corresponding driver 358*a,* 358*b,* 430 or pump 340, 427 when it is depressed and released. Immediately below pushbuttons 408 in each column 406*a*–*e*06*d* are speed controls 410 in the form of rotary knobs. Rotation of controls 410 adjusts speed of the corresponding drivers 358*a,* 358*b,* 430 or pump 427 between a predetermined minimum and maximum through control subsystem 402.

In the case of columns 406*a* and 406*c,* a momentary pushbutton 412 is also included. Subsystem 402 responds to the depression of pushbutton 412 to cause the corresponding driver 358*a* or 358*b* to turn in a reverse rotational direction for as long as the momentary pushbutton 412 remains depressed. This "reverse jog" operation is helpful to address clogging and/or jamming of mixer 301.

Meter 418 of control panel 404 displays a numeric value corresponding to the rate of delivery of colorant being metered with pump 427. Meter 418 can be of an LED, LCD, or other type as would occur to those skilled in the art. Control panel 404 further includes an emergency stop button (labeled "E-stop") to halt all operations of drivers 358*a,* 358*b,* 430 and pumps 340, 427 and send an alarm via horn 416.

Control subsystem 402 is configured to cause drivers 358*a,* 358*b,* 430 and pumps 340, 427 to respond to operator manipulation of the controls of panel 404 in the manner described. Control subsystem 402 can be comprised of a collection of components or configured as a single integral unit. When of a multi-component form, controller 402 may have one or more components remotely located relative to the others, or otherwise have its components distributed throughout system 400. Subsystem 402 can include circuitry that is programmable, arranged as a state logic machine or other type of dedicated hardware, or configured as a hybrid combination of programmable and dedicated hardware. When such circuitry is involved, it can be of a digital variety, analog variety, or both. As an addition or alternative to electronic circuitry, subsystem 402 may include one or more mechanical, hydraulic, pneumatic, or optical elements. Control subsystem 402 includes any interface/control circuits or elements necessary to interface with drivers 358*a,* 358*b,* 430, and pumps 340, 427. For embodiments where drivers 358*a,* 358*b* are in the form of electric motors, corresponding variable speed motor control circuitry is included in subsystem 402. In one embodiment, control subsystem 402 also includes a programmable, integrated circuit-based processor with appropriate digital memory capacity. For this embodiment, the processor is programmed to generate appropriate control signals for the driver and/or pump interfaces of subsystem 402 in response to input signals from the controls of panel 404.

In one mode of operation of system 400, solid pieces are introduced into mixer 301 through inlet 352. In section 303, rotary conveying member 360*a* rotates to move the introduced pieces from inlet 352 to rotary conveying member 360*b* of section 305. Liquid is introduced into chamber 356 in the vicinity of section 305 to be intermixed with the solid pieces. Rotary conveying member 360*b* also continues to move the pieces to outlet 354 for discharge and subsequent removal by conveyor 70. Because liquid is introduced in section 305, section 303 primarily operates as a feeder of the pieces and section 305 primarily operates to intermix the pieces and liquid, and discharge the mixture. Nonetheless, at least some degree of solid/liquid mixing can occur in section 303 with rotary conveying member 360*a* and at least some degree of feeding can occur in section 305 with rotary conveying member 360*b*. In alternative embodiments, feeding and mixing can be generally exclusive to one or more rotary conveying members, or both can be performed with a given rotary conveying member.

It has been found that operating the rotary conveying member 360*a* of section 303 and rotary conveying member 360*b* of section 305 at different rotational speed via controls 410 can improve mixing results. The speed of members 360*a,* 360*b* can be adjusted during operation via corresponding controls 410 in response to one or more factors of interest, including, but not limited to, quality of the mixture being discharged; quantity of materials processed; amount of liquid run-off; the size, size distribution, porosity, absorption, or other property of the solid pieces; and the degree of clogging. In one operating mode of mixer 301, it is preferred that the rotational speed of rotary conveying member 360*a* be slower than the rotational speed of rotary conveying member 360*b*. In another more preferred operating mode of mixer 301, rotary conveying member 360*a* rotates at a rotational speed that is in a range of 40% to 80% of the rotational speed of rotary conveying member 360*b*. In a still more preferred operating mode, rotary conveying member 360*a* has a maximum rotational speed of about 40 revolutions per minute (RPM) and rotary conveying member 360*b* has a maximum rotational speed of about 300 RPM. Naturally, for other operating modes and embodiments, the relative speed differences between two or more rotary conveying members can otherwise differ or be the same.

Further, paddles 365*a,* 365*b* can be arranged, sized, and adjusted to provide feeder action while paddles 365*c* and flights 362*b* and 362*c* can be arranged, sized, and adjusted to provide a desired mixing action in addition to or as an alternative to moving the pieces along axis R. Indeed, in one alternative embodiment it is desirable to angle one or more paddles in a manner that tends to reverse the direction of advancing pieces to increase dwell time. In addition, paddles and flights in contact with the mixture can be configured to ameliorate clogging. Accordingly, as used herein, a "rotary conveying member" broadly refers to any member that rotates to move solid pieces in contact therewith, including, but not limited to any member that rotates to move such pieces in a generally common direction, to move one or more of such pieces in different directions, and/or to change the direction of motion of one or more of such pieces. Also, it should be understood that for the depicted embodiment of mixer 301, liquid can also reach pieces in section 303, such that rotary conveying member 360*a* can also perform solid/liquid mixing; however, shelf 370 tends to limit the amount of liquid backflow. Instead, liquid tends to accumulate in the bottom of section 305.

In embodiments in which one or more rotary conveying members include flights, the flights can be spaced apart from the shaft or such spaces may be absent. Flights can alternatively or additionally extend along a majority of the length of either rotary conveying member as in the case of auger 60 of mixer 41. Indeed in one embodiment, one or more of the rotary conveying members are configured as a conventional screw conveyor with continuous helical flighting. Furthermore, flights may be configured as previously described in connection with systems 10 or 210.

In other embodiments, in addition or as an alternative to adjustment with control panel 420, speed of rotary conveying member 360*a* and/or 360*b* can be automatically controlled based upon feedback from one or more sensors (not shown). Such sensors can be used, for example, to continuously or periodically detect the volumetric flow rate of the solid pieces, to detect the amount of liquid being introduced into the system, to detect the amount of liquid being collected from the system that does not adhere to or become absorbed in the solid pieces, and/or to detect the presence of solid pieces being introduced into mixer 301 and/or removed by conveyor 70. In still other embodiments, such sensors may be absent. Indeed, subsystem 402 and/or control panel 404 can be absent, instead providing for adjustability of the driver or pump directly. In yet another embodiment, the rate of only one of drivers 358*a,* 358*b* is adjustable. Also, operator inputs and outputs may be provided by other devices in addition or as an alternative to those described in connection with control panel 404, including, but not limited to push buttons, levers, or slides to adjust operating speeds, keyboard entered commands, or graphical user interface (GUI) controls, just to name a few.

Besides controlling drivers 358*a,* 358*b* and 430 and liquid dispensing subsystem 325, in other embodiments subsystem 402 can also be used for a variety of record keeping functions, such as maintaining a record of the amount of liquid dispensed with pump 427 or volume of solid pieces passing through mixer 301 over a given period of time. Subsystem 402 can also be configured to provide an operator preferred parameters for motor speed and liquid introduction rate. Also, it can be configured to assist the operator with adjustments relating to different wood chip types, sizes, or delivery rates, when wood chips are being processed in mixer 301. In one embodiment, subsystem 402 and control panel 404 are embodied, at least in part, in a ruggedized personal computer customized with appropriate hardware and software to controllably interface with other components of mixer 301 and including a conventional graphic video display and keyboard (not shown) to facilitate operator input and output.

Accordingly, mixer 301 can be utilized to mix a wide variety of solid pieces 42 with a wide variety of liquids as would be contemplated by one of skill in the art. For example, various colorants and/or high gloss transparent or translucent coatings, such as, for example, polymer coatings, can be applied to certain types of landscaping rocks or gravel in accordance with the invention. In another example, mixer 301 is utilized to impart colorant and/or scent to wood chips for the production of landscaping mulch. In still another example, colorant and/or scent is applied to cinders to provide a form of landscaping rock. In one embodiment of a cinder application, at least a portion of the cinder pieces each have a maximum dimension of one inch or more.

In some alternative embodiments of the invention (not shown), the conveying/mixing system includes two independently driven rotary conveying members disposed within the chamber that do not share a common rotational axis. For such embodiments, rotary conveying members may be arranged along parallel rotational axes or the rotational axis may be set at an angle with respect to one another. In still other embodiments, the shafts of the two rotary conveying members overlap, extending past one another in a parallel or angled configuration.

In a further alternative embodiment (not shown), a conveying/mixing system includes more than two independently driven rotary conveying members disposed within the chamber and aligned to move material from one member to the next. The rotary conveying members can be positioned to rotate around a generally common rotational axis or offset in a parallel or angled arrangement. In another embodiment of the invention (not shown), a mixing system is provided that includes different sets of multiple rotary conveying members operable to turn at different speeds. In one example of such an embodiment, the sets are arranged to be generally parallel to one another.

Another embodiment of the present invention includes providing a number of solid pieces to an inlet of a mixer that includes a chamber intersecting the inlet and an outlet intersecting the chamber; introducing a liquid into the chamber between the inlet and the outlet; and rotating two rotary conveying members at different speeds within the chamber to move the solid pieces from the inlet towards the outlet and intermix the solid pieces with the liquid. A first one of the rotary conveying members moves the solid pieces from the inlet to a second one of the rotary conveying members and the second one of the rotary conveying members discharges the solid pieces through the outlet. It should be understood that one or both of the rotary conveying members can perform the intermixing of the pieces and liquid, and that one or both of the rotary conveying members moves solid pieces towards the outlet.

Still another embodiment of the present invention includes: introducing wood pieces into a mixing chamber through an inlet, where the chamber includes an outlet spaced apart from the inlet; providing a liquid to the chamber including a colorant; rotating a first rotary conveying member disposed within the chamber at a first rotational speed to move the wood pieces from the inlet to a second rotary conveying member disposed within the chamber; rotating the second rotary conveying member at a second rotational speed different from the first rotational speed to move the wood pieces; and discharging the pieces through the outlet.

Yet a further embodiment includes providing solid pieces to a mixing chamber through an inlet that is spaced apart from a chamber outlet. A liquid is provided to the chamber for mixing with the solid pieces. An rotary conveying member is disposed within the chamber to move the solid pieces from the inlet toward the outlet when rotated in a first rotational direction. A control is provided to rotate the rotary conveying member in a second rotational direction opposite the first rotational direction to address clogging of the mixing chamber. The solid pieces can be in the form of wood chips and the liquid can include a colorant.

In other embodiments, the various components and operations of systems 10, 210, 400 can be interchanged, deleted, substituted, combined, modified, divided or reordered as would occur to one skilled in the art without departing from the spirit of the invention All publications, patents, and patent applications cited in this specification are herein incorporated by reference as if each individual publication, patent, or patent application were specifically and individually indicated to be incorporated by reference and set forth in its entirety herein, including, but not limited to commonly owned U.S. Pat. No. 5,866,201 to Blue, commonly owned U.S. patent application Ser. No. 09/231,691 filed Jan. 14, 1999, and the commonly owned U.S. Patent Application entitled "Landfill Operation Techniques and Solid/Liquid Mixing Systems" filed on May 31, 2000. Further, it is not intended that the present invention be limited or restricted to any expressed theory or mechanism of operation provided herein. While the invention has been illustrated and described in detail in the drawings and foregoing description, the same is to be considered as illustrative and not restrictive in character, it being understood that only exemplary embodiments have been shown and described and that all changes, modifications and equivalents that come within the spirit of the invention as defined by the following claims are desired to be protected.

What is claimed is:

1. A system, comprising:

a first pump to meter colorant;

a second pump in fluid communication with the output of the first pump and a water supply input to pressurize a mixture of water and colorant;

a mixer body including a chamber with an inlet and an outlet and one or more liquid input ports in fluid communication with said second pump to receive the mixture under pressure, said chamber being configured to receive solid pieces through said inlet and to discharge the pieces through said outlet;

a first rotary conveying member positioned in the chamber adapted to convey the solid pieces from the inlet toward the outlet;

a second rotary conveying member positioned in the chamber to intermix the mixture and the solid pieces and to convey the solid pieces to the outlet; and one or more drivers operable to provide rotational mechanical power to rotate the first and second rotary conveying members at different speeds relative to one another.

2. The system of claim 1, further comprising a static liquid mixer coupled between the first pump and the second pump, said static liquid mixer including a number of baffles operable to intermix the water and colorant to provide the mixture.

3. The system of claim 2, further comprising a manifold in fluid communication with said second pump.

4. The system of claim 3, wherein the one or more liquid input ports include a number of nozzles in fluid communication with said manifold.

5. The system of claim 1, wherein at least one of said rotary members is an auger with spiral lighting that rotates about a shaft.

6. A system comprising:

a first pump to meter colorant;

a second pump to pressurize a mixture of water received from a water supply and colorant received from the first pump;

a mixer body including a chamber with an inlet and an outlet and one or more liquid input ports in fluid communication with said second pump to receive the mixture under pressure, said chamber being configured to receive solid pieces through said inlet and to discharge the pieces through said outlet;

one or more rotary conveying members positioned in said chamber to intermix the mixture and the solid pieces and to convey the solid pieces from the inlet to the outlet, at least one of said one or more rotary members including a shaft with a number of fixed paddles and a number of adjustable-pitch paddles; and one or more drivers operable to provide rotational mechanical power to rotate said one or more rotary conveying members.

7. A system, comprising:

a pump connected to a source of colorant;

a mixer body including a chamber with an inlet and an outlet and one or more liquid input ports in fluid communication with said pump to receive the colorant, the chamber being configured to receive solid pieces through said inlet and to discharge the pieces through the outlet;

one or more rotary conveying members positioned in the chamber to intermix the colorant and the solid pieces and to convey the solid pieces from the inlet to the outlet, at least one of the one or more rotary members comprising a shaft with a plurality of adjustable-pitch paddles; and one or more drivers operable to provide rotational mechanical power to rotate the one or more rotary conveying members.

8. A system, comprising:

a pump in fluid communication with a colorant source;

a mixer body including a chamber with an inlet and an outlet and one or more liquid input ports in fluid communication with said pump to receive the colorant, the chamber being configured to receive solid pieces through said inlet and to discharge the pieces through the outlet, a first rotary conveying member positioned in the chamber for conveying solid pieces from the inlet toward the outlet;

a second rotary conveying member positioned in said chamber to intermix colorant and solid pieces and to convey solid pieces to the outlet; and one or more drivers operable to rotate said rotary conveying members at different speeds relative to each other.

* * * * *